US005147766A

United States Patent [19]

Ishikawa et al.

[11] Patent Number: 5,147,766

[45] Date of Patent: Sep. 15, 1992

[54] METHOD FOR PROCESSING A SILVER HALIDE COLOR PHOTOGRAPHIC MATERIAL

[75] Inventors: Takatoshi Ishikawa; Kazuaki Yoshida; Hiroshi Fujimoto, all of Kanagawa, Japan

[73] Assignee: Fuji Photo Film Co., Ltd., Kanagawa, Japan

[21] Appl. No.: 578,370

[22] Filed: Sep. 6, 1990

[30] Foreign Application Priority Data

Sep. 7, 1989 [JP] Japan ..... 1-232481
Sep. 7, 1989 [JP] Japan ..... 1-232483

[51] Int. Cl.[5] ..... G03C 5/35

[52] U.S. Cl. ..... 430/399; 430/434; 430/467; 430/484; 430/485; 430/490

[58] Field of Search ..... 430/399, 434, 464, 467, 430/490, 484, 485

[56] References Cited

U.S. PATENT DOCUMENTS

| | | | |
|---|---|---|---|
| 4,797,351 | 1/1989 | Ishikawa et al. | 430/399 |
| 4,798,783 | 1/1989 | Ishikawa et al. | 430/380 |
| 4,800,153 | 1/1989 | Morimoto et al. | 430/380 |
| 4,801,516 | 1/1989 | Ishikawa et al. | 430/380 |
| 4,801,521 | 1/1989 | Ohki et al. | 430/380 |
| 4,818,673 | 4/1989 | Ueda et al. | 430/566 |
| 4,820,623 | 4/1989 | Koshimizu et al. | 430/399 |
| 4,826,757 | 5/1989 | Yamada et al. | 430/399 |
| 4,839,263 | 6/1989 | Miyoshi et al. | 430/963 |
| 4,853,321 | 8/1989 | Momoki et al. | 430/380 |
| 4,880,728 | 11/1989 | Ishikawa et al. | 430/380 |
| 5,002,862 | 3/1991 | Yagihara et al. | 430/484 |
| 5,004,676 | 4/1991 | Meckl et al. | 430/399 |

FOREIGN PATENT DOCUMENTS

| | | |
|---|---|---|
| 0269740 | 6/1988 | European Pat. Off. . |
| 0330442 | 8/1989 | European Pat. Off. . |
| 2850173 | 6/1980 | Fed. Rep. of Germany . |

OTHER PUBLICATIONS

Derwent Abstracts of J61-070552, Apr. 11, 1986.
Derwent Abstracts of J63-106655, May 11, 1988.
Derwent Abstracts of J01-105948, Apr. 24, 1989.
Patent Abstracts of Japan vol. 4, No. 138 (p-29)(620) Sep. 27, 1980 & JPA-55 089834 (Konishiroku Shashin Kogyo K.K.) Jul. 7, 1980.
Patent Abstracts of Japan vol. 13, No. 355 (P-914)(3703) Aug. 9, 1989, & JPA-01 114843 (Fuji Photo Film Co., Ltd.) May 8, 1989.
Journal of the Society of Motion Picture Engineers, vol. 88, No. 3, Mar. 1979, New York U.S. pp. 165-167 Lewis E. Allen; "Ion-Exchange Recovery Techniques for the Reuse of Color Developers".
British Kinematography Sound and Television Society Journal, vol. 66, No. 7, Jul. 1984, London GB pp. 320-324; J. Paizs; "How to Minimize Developer Consumption".

*Primary Examiner*—Hoa Van Le
*Attorney, Agent, or Firm*—Sughrue, Mion, Zinn Macpeak & Seas

[57] ABSTRACT

A method for continuously processing an image-wise exposed silver halide color photographic material comprising a support having thereon at least one silver halide emulsion layer containing 95 mol % or more of silver chloride is disclosed, which comprises the steps of developing the silver halide color photographic material in a color developer and supplying a replenisher to the color developer, the replenisher comprising used color developer and a regenerant wherein components accumulated to the color developer during the continuous processing are not removed from the replenisher. This method does not require a large scale apparatus and provides stable photographic properties without substantially producing waste water and without causing crystallization of chemicals in a replenisher even after repeated regeneration, particularly when varying the amount of light-sensitive material being processed per unit time.

12 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material. More particularly, the present invention relates to a method for processing a silver halide color photographic material which comprises reusing used color developer as a replenisher during continuous processing, to thereby reduce the amount of waste liquid and the operating cost.

BACKGROUND OF THE INVENTION

In the processing of a silver halide color photographic material, used processing solutions are normally discarded as an overflow waste liquid.

However, the used processing solutions which are collected and discarded are a significant source of environmental pollution. The cost of collection and disposal of used waste processing solutions is substantial. Accordingly, if the used processing solutions (i.e., overflow waste liquids) can be reused as a replenisher, the above described problems can be eliminated. Furthermore, effective components remaining in the overflow waste liquids are also potentially reused. Accordingly, the required amount and cost of fresh replenisher chemicals would be further reduced. Therefore, many regeneration studies have been conducted in an effort to enable the reuse of used processing solutions by accommodating for the fluctuation in the processing solution caused by the processing, namely, by removing accumulated components that adversely affect the photographic properties and by adjusting for the reduction in activity caused by consumption of the processing solution components.

In particular, the process for the color development of a color photographic material yields a highly alkaline aqueous waste which results in substantial organic contamination represented by BOD (biochemical oxygen demand). Furthermore, the color development process requires expensive chemicals. Consequently, various approaches have been proposed with respect to chemical conservation and waste reduction for the color development process.

As described above, the regeneration normally requires the removal of accumulated components harmful to photographic properties and the replenishment of active components consumed by the process. In particular, means for removal of accumulated harmful components has been investigated. In the color development, an area of great interest has been the removal of bromide ion eluted from the light-sensitive material which strongly inhibits development. For example, an approach for regeneration utilizing electrodialysis is proposed in JP-A-51-85722, JP-A-54-37731, JP-A-56-1049, JP-A-56-27142, JP-A-56-33644 and JP-A-56-149036 (the term "JP-A" as used herein means an "unexamined published Japanese patent application"), and JP-B-61-10199 and JP-B-61-52459 (the term "JP-B" as used herein means an "examined Japanese patent publication"). In addition, other various approaches for the regeneration of color developers have been proposed. JP-B-55-1571 and JP-A-58-14831 propose the utilization of activated carbon. JP-A-52-105820 propose the utilization of ion exchange membranes. JP-A-55-144240, JP-A-53-132343, JP-A-57-146249, and JP-A-61-95352 propose the utilization of ion exchange resins.

However, the above described approaches require the analysis of the developer in order to control the composition of the developer. Thus, a highly precise control technique and expensive apparatus is also required. Accordingly, analysis and control techniques have been employed in some large scale processing laboratories.

On the other hand, another approach has been proposed which does not employ an analysis and control technique. In this approach, the composition of the replenisher of the color developer (color developer replenisher) is controlled to reduce the replenishment rate. In the above-described low replenishment process, the control of the composition of the replenisher is accomplished by, e.g., concentrating the components of the replenisher that are consumed such as the color developing agent and preservative, such that the required amounts of the replenishment components are supplied using a reduced replenishment rate. When a silver halide color photographic material is processed, halogen ions are released into the color developer. In the low replenishment process, this causes a rise in bromide ion concentration in the color developer, inhibiting development. Accordingly, in order to reverse this phenomenon, various approaches have been proposed. For example, the bromide concentration in the replenisher is generally reduced from that employed in the ordinary replenishment process.

Further approaches have been proposed in JP-A-61-70552, JP-A-63-106655, and JP-A-1-105948. In these approaches, a silver halide photographic material having a high silver chloride content is used to reduce the accumulation of bromide ion released into the color developer, to thereby also reduce the replenishment rate. Alternatively, the replenishment rate is reduced to an extent that the replenishment does not overflow the processing tank.

The low replenishment process using a silver halide photographic material having a high silver chloride content is advantageous in that large scale facilities are not required. However, the low replenishment process requires the concentration of the replenisher to supply the required amount of essential components as described above. The low replenishment process is therefore disadvantageous in that developing agents, fluorescent brightening agents and preservatives are easily crystallized and the replenishment precision is degraded, to thereby result in fluctuation of photographic properties.

After considering the above-described problems, the present inventors have conducted extensive studies to provide a remarkably improved regeneration process which eliminates of the necessity of large scale regeneration apparatus and overcomes problems caused by the concentration of the replenisher, by using only a silver halide photographic material having a high silver chloride content and by compensating for the consumption of essential components without removing halides from the used color developer. After further studies, the present inventors have found that in the development of a light-sensitive material, as the regeneration is repeated time after time, a fluctuation in photographic properties results, thereby making it difficult to obtain fully satisfactory results. In particular, the resulting photographic properties were found to vary with the amount of light-sensitive material being processed per unit time. More particularly, if the amount of light-sensitive material being processed is small, a reduction in sensitivity and high contrast results. On the other hand, if the amount of the light-sensitive material being processed is large, a rise in sensitivity and low contrast results.

SUMMARY OF THE INVENTION

An object of the present invention is to provide a simple method for the regeneration of a color developer which does not require a large scale apparatus.

A second object of the present invention is to provide a method for the regeneration of a color developer which provides stable photographic properties without substantially producing waste water and without causing crystallization of chemicals in a replenisher even after repeated regeneration, particularly when varying the amount of light-sensitive material being processed per unit time.

The above and other objects of the present invention will become more apparent from the following detailed description and Examples.

The objects of the present invention are accomplished by a method for continuously processing an image-wise exposed silver halide color photographic material comprising a support having thereon at least one silver halide emulsion layer containing 95 mol % or more of silver chloride, comprising developing the silver halide color photographic material in a color developer and supplying a replenisher to the color developer, the replenisher comprising used color developer and a regenerant wherein components accumulated in the color developer during the continuous processing are not removed from the replenisher.

In a preferred embodiment, the color developer for use in the present invention contains at least one compound selected from the compounds represented by the general formulae (I) and (II):

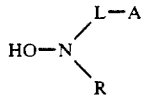

(I)

wherein L represents a substituted or unsubstituted alkylene group; A represents a carboxy group, a sulfo group, a phosphono group, a phosphinic acid residue, a hydroxy group, an amino group which may be alkyl-substituted, an ammonio group which may be alkyl-substituted, a carbamoyl group which may be alkyl-substituted, a sulfamoyl group which may be alkyl-substituted or an alkylsulfonyl group which may be alkyl-substituted; and R represents a hydrogen atom or a substituted or unsubstituted alkyl group:

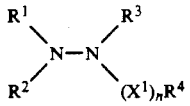

(II)

wherein $R^1$, $R^2$ and $R^3$ each independently represent a hydrogen atom, an alkyl group, an aryl group or a heterocyclic group; $R^4$ represents a hydrogen atom, a hydroxyl group, a hydrazino group, an alkyl group, an aryl group, a heterocyclic group, an alkoxy group, an aryloxy group, a carbamoyl group or an amino group; $X^1$ represents a divalent group; and n represents an integer of 0 or 1, with the proviso that when n is 0, $R^4$ represents an alkyl group, an aryl group or a heterocyclic group, or $R^3$ and $R^4$ combine to form a heterocyclic group.

DETAILED DESCRIPTION OF THE INVENTION

In accordance with the method of the present invention, the concentration of bromide ion eluted and accumulated in the color developer is kept low by using a silver halide color photographic material having a high silver chloride content. This enables the reuse of used developer (overflow liquid) without having to remove halogen components. Furthermore, regenerants can be incorporated into the overflow liquid in a lower concentration to compensate for consumption of essential components to prepare a color developer replenisher. By incorporating the regenerants into the overflow liquid in a lower concentration (i.e., use of a larger amount of the overflow liquid), problems caused by the concentration of the replenisher, e.g., crystallization of chemicals and poor replenishment precision which are characteristic of the low replenishment process are eliminated. This further eliminates the resulting fluctuation in photographic properties, particularly fluctuation in photographic properties caused by variation of the amount of light-sensitive material being processed per unit time.

Accordingly, the regeneration of a color developer in accordance with the present invention is different from the addition of regenerants compensate for the consumption of essential components after removal of halogen components as practiced in prior art electrodialysis processes using ion exchanging membranes or processes using ion exchanging resins. Namely, the regeneration of a color developer in accordance with the present invention means repeated reuse of used color developer (overflow liquid) accomplished only by adding a regenerant to compensate for consumption of essential components without removing components (particularly bromide ion) eluted and accumulated in the color developer. In the present invention, "used" color developer is the overflow liquid from the color developing tank. The conclusion of the "used" color developer depends, among other things, on the replenishment rate, tank volume, composition of replenisher, type and amount of components eluted from the processed photographic material, type and amount of components consumed in the development, carryover to the next step, etc.

The concentration of components (particularly bromide ion) accumulated in the developer in the color developing bath, i.e., overflow liquid, can be controlled by adjusting the amount of the color developer carried over to the succeeding baths. In the present invention, it was found that the carryover is preferably in the range of 30 to 80 ml, particularly 40 to 70 ml per $m^2$ of light-sensitive material.

In the present invention, the color developer thus regenerated is supplied as a replenisher in a constant amount depending on the amount of light-sensitive material being processed. If the evaporation in the developing bath is not taken into account, the overflow liquid is discharged in an amount obtained by subtracting the amount carried over from the replenishment rate. In the present invention, the overflow liquid is generally collected in a tank or the like (stock tank). After the lapse of a predetermined period of time (e.g., time at which the stocked amount of the overflow liquid reaches a predetermined volume, or the amount of light-sensitive material processed reaches a predetermined value), regenerants are added to the stocked overflow liquid to prepare a color developer replenisher. The regeneration process may be repeated. As the regeneration is repeated more often, the various components in the tank reach certain equilibrium concentrations to thereby maintain stable photographic properties.

When the regeneration of a color developer is repeated more often, the present invention is especially effective. More specifically, when round number (turn over) is at least 10, particularly at least 20, the color light-sensitive material using a high silver chloride content emulsion in accordance with the present invention can obtain greatly stable photographic properties, wherein the round number represents the following equation:

$$\text{Round number} = \frac{\text{Total replenishing amount}}{\text{Tank volume capacity}}$$

That is, the method of the present invention is particularly effective for the system in which a large amount of the component which is eluted from the light-sensitive material and is accumulated in the processing solution is present. This is an unexpected fact in the light of the system using the conventional color light-sensitive material comprising a silver chlorobromide emulsion.

In the method of the present invention, as the replenishment rate increases with respect to the amount of the processing solution carried over, it is not necessary to concentrate chemicals in the replenisher. In the present invention, upon repeated regeneration of a color developer, the replenishment rate is preferably in the range of 1.2 to 20 times, particularly 1.5 to 5 times the amount of the processing solution carried over by the light-sensitive material. The replenishment rate can range from, e.g., 60 to 1,000 ml, particularly 120 to 400 ml per $m^2$ of light-sensitive material. The general range for the volume capacity of the color developing tank is 10 l to 10 $m^3$, preferably 100 l to 5 $m^3$.

Further, in the present invention, when regenerating rate (i.e., the utilization of overflow liquid) is high, the resulting effects are more sufficient. This is also unexpectable. Specifically, it is preferred for the present invention that the regenerating rate is at least 80%, particularly 90–100%, wherein the regenerating rate represents the following equation:

$$\text{Regenerating rate} = \frac{\text{Amount of overflow liquid to be used for regeneration}}{\text{Total amount of overflow liquid}} \times 100$$

It has not been known that the regeneration processing can be sufficiently conducted, even when the overflow liquid containing a large amount of the accumulated components is used at a high ratio.

The color developer for processing the light-sensitive material of the present invention is an alkaline aqueous solution preferably comprising an aromatic primary amine color developing agent as a main component. A useful color developing agent is an aminophenol compound, preferably a p-phenylenediamine compound. Examples of the p-phenylenediamine compound include 3-methyl-4-amino-N,N-diethylaniline, 3-methyl-4-amino-N-ethyl-N-β -hydroxyethylaniline, 3-methyl-4-amino-N-ethyl-β-methanesulfonamideethylaniline, 3-methyl-4-amino-N-ethyl-N-β-methoxyethylaniline, and sulfates, hydrochlorides and p-toluenesulfonates thereof. The color developing agents can be used in combination depending on the purpose of application.

The color developer for use in the present invention generally comprises a pH buffer such as a carbonate, borate or phosphate of an alkaline metal, a development inhibitor or fog inhibitor such as bromide, iodide, benzimidazole, benzothiazole and mercapto compound. Typical examples of other additives which can be incorporated into the present color developer include various preservatives such as hydroxylamine, diethylhydroxylamine, sulfite, hydrazine, phenylsemicarbazide, triethanolamine, catecholsulfonic acid, and triethylenediamine(1,4-diazabicyclo[2,2,2]octane), organic solvents such as ethylene glycol and diethylene glycol, development accelerators such as benzyl alcohol, polyethylene glycol, quaternary ammonium salts and amines, dye-forming couplers, competing couplers, fogging agents such as sodium boron hydride, auxiliary developing agents such as 1-phenyl-3-pyrazolidone, thickening agents, and various chelating agents such as aminopolycarboxylic acid, aminopolyphosphonic acid, alkylphosphonic acid and phosphonocarboxylic acid (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof. However, the present color developer preferably comprises substantially no benzyl alcohol. The benzyl alcohol content is preferably in the range of 2 ml or less per liter of the color developer, and more preferably contains no benzyl alcohol.

The color developer for use in the present invention preferably contains at least one compound selected from the compound represented by the general formulae (I) and (II) as a preservative.

The compound represented by the general formula (I) is further described below.

In the general formula (I), L represents an alkylene group which may be substituted. L preferably represents a $C_{1-10}$, preferably $C_{1-5}$, straight or branched alkylene group which may be substituted. Specific examples of the alkylene group include methylene, ethylene, trimethylene, and propylene. Examples of substituents for the group L include a carboxy group, a sulfo group, a phosphono group, a phosphinic acid residue, a hydroxy group, and an ammonio group which may be substituted by an alkyl group (preferably a $C_{1-5}$ alkyl group). Preferred among these substituents are a carboxy group, a sulfo group, a phosphono group, and a hydroxy group. A represents a carboxy group, a sulfo group, a phosphono group, a phosphinic acid residue, a hydroxy group, an amino group which may be substituted by an alkyl group (preferably a $C_{1-5}$ alkyl group), an ammonio group which may be substituted by an alkyl group (preferably a $C_{1-5}$ alkyl group), a carbamoyl group which may be substituted by an alkyl group (preferably a $C_{1-5}$ alkyl group), a sulfamoyl group which may be substituted by an alkyl group (preferably a $C_{1-5}$ alkyl group), and an alkylsulfonyl group which may be substituted by an alkyl group (preferably a $C_{1-5}$ alkyl group). Preferred among these compounds are a carboxy group, a sulfo group, a hydroxy group, a phosphono group, and a carbamoyl group which may be alkyl-substituted. Preferred examples of —L—A include carboxymethyl group, carboxyethyl group, carboxypropyl group, sulfoethyl group, sulfopropyl group, sulfobutyl group, phosphonomethyl group, phosphonoethyl group, and hydroxyethyl group. Particularly preferred among these groups are carboxymethyl group, carboxyethyl group, sulfoethyl group, sulfopropyl group, phosphonomethyl group, and phosphonoethyl group. R represents a hydrogen atom or a $C_{1-10}$, preferably $C_{1-5}$, straight or branched alkyl group which may be substituted. Examples of substituents for the alkyl group include carboxy group, sulfo group, phosphono group, phosphinic acid residue, hydroxy group, amino group which may be substituted by an alkyl group, ammonio group which may be substituted by an alkyl group, carbamoyl group which may be substituted by an alkyl group, sulfamoyl group which may be substituted by an alkyl group, alkylsulfonyl group which may be substituted by an alkyl group, acylamino group, alkylsulfonylamino group, arylsulfonylamino group, alkoxycarbonyl group, amino group which may be substituted by an alkyl group, arylsulfonyl group, nitro group, cyano group, and halogen atom. The alkyl group represented by R may contain two or more substituents. Preferred examples of the group represented by R include methyl group, ethyl group, propyl group, hydrogen atom, carboxymethyl group, carboxyethyl group, carboxypropyl group, sulfoethyl group, sulfopropyl group, sulfobutyl group, phosphonomethyl group, phosphonoethyl group, and hydroxylethyl group. Particularly preferred among these groups are hydrogen atom, carboxymethyl group, carboxyethyl group, sulfoethyl group, sulfopropyl group, phosphonomethyl group, and phosphonoethyl group. L and R may combine to form a ring.

Among the compounds represented by the general formula (I), those having a dissociation proton may form a salt of sodium, potassium, ammonium, lithium, etc.

Specific examples of the compound represented by the general formula (I) are set forth below, but the present invention is not be construed as being limited thereto.

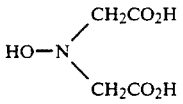
(I-1)

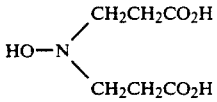
(I-2)

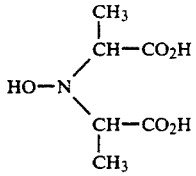
(I-3)

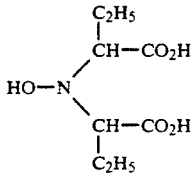
(I-4)

-continued

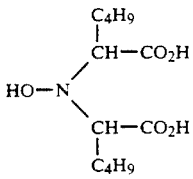
(I-5)

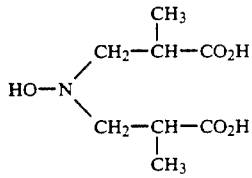
(I-6)

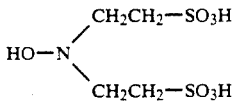
(I-7)

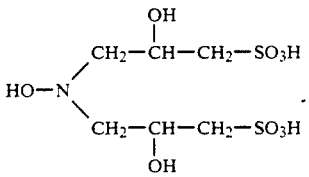
(I-8)

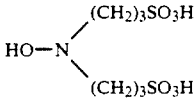
(I-9)

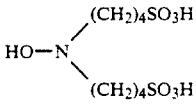
(I-10)

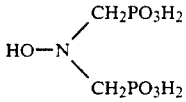
(I-11)

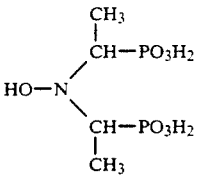
(I-12)

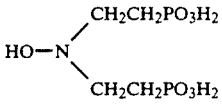
(I-13)

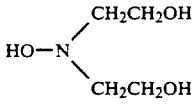
(I-14)

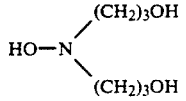
(I-15)

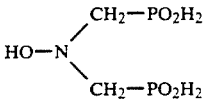
(I-16)

-continued

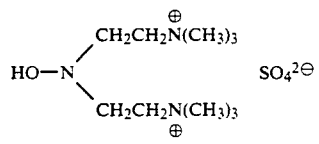
(I-17)

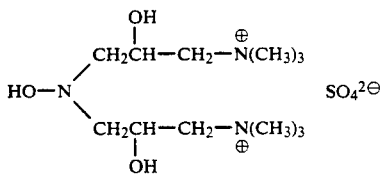
(I-18)

$HO-NH-CH_2CO_2H$ (I-19)

$HO-NH-CH_2CH_2CO_2H$ (I-20)

$HO-NH-CH(CH_3)-CO_2H$ (I-21)

$HO-NH-CH(C_2H_5)-CO_2H$ (I-22)

$HO-NH-CH(C_4H_9)-CO_2H$ (I-23)

$HO-NH-CH(CH_3)-CH_2-CO_2H$ (I-24)

$HO-NH-CH_2-CH(CH_3)-CO_2H$ (I-25)

$HO-NH-CH_2CH_2SO_3H$ (I-26)

$HO-NH-CH_2CH(OH)CH_2SO_3H$ (I-27)

$HO-NH(CH_2)_3SO_3H$ (I-28)

$HO-NH(CH_2)_4SO_3H$ (I-29)

$HO-NH-CH_2PO_3H_2$ (I-30)

$HO-NH-CH(CH_3)-PO_3H_2$ (I-31)

$HO-NH-CH_2CH_2PO_3H_2$ (I-32)

$HO-NH-CH_2CH_2OH$ (I-33)

$HO-NH(CH_2)_3OH$ (I-34)

$HO-NH-CH_2-PO_2H_2$ (I-35)

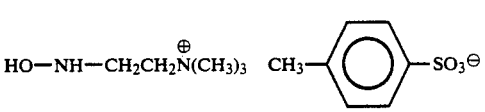
(I-36)

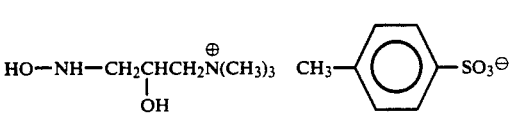
(I-37)

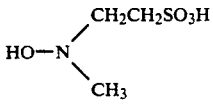
(I-38)

-continued

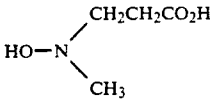
(I-39)

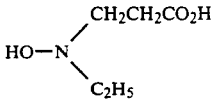
(I-40)

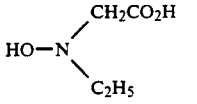
(I-41)

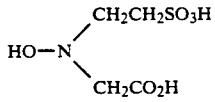
(I-42)

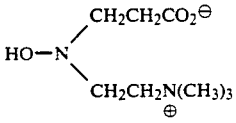
(I-43)

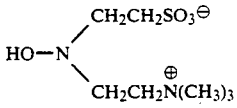
(I-44)

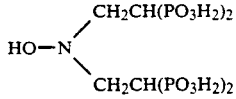
(I-45)

$HONHCH_2CH(PO_3H_2)_2$ (I-46)

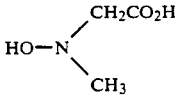
(I-47)

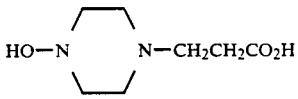
(I-48)

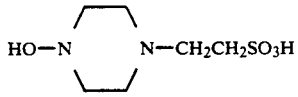
(I-49)

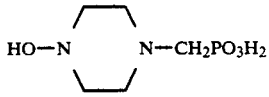
(I-50)

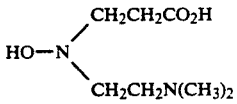
(I-51)

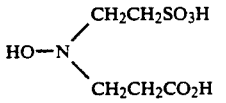
(I-52)

The compounds represented by the general formula (I) can be synthesized by subjecting commercially available hydroxylamines to alkylation reaction (nucleophilic substitution reaction, addition reaction, Mannich reaction, etc.). Specifically, the compounds can be synthesized in accordance with the methods described in West German Patent 1,159,634, *Inorganica Chimica Acta*, 93, (1984) pp. 101-108, etc. Typical examples of the synthesis methods for the compounds of the general formula (I) are described in detail below.

Synthesis of Compound I-7

To 200 ml of aqueous solution containing 20 g of hydroxylamine hydrochloride, 11.5 g of sodium hydroxide and 96 g of sodium chloroethane sulfonate were added. The mixed aqueous solution was kept at 60° C. and 40 ml of aqueous solution containing 23 g of sodium hydroxide was gradually added thereto over 1 hour. After maintaining at 60° C. for 3 hours, the reactive solution was concentrated under reduced pressure, 200 ml of concentrated hydrochloric acid was further added thereto and the solution was heated to 50° C. Then, the insoluble matter was filtrated and 500 ml of methanol was added to the filtrate to obtain 41 g (yield: 53%) of the aimed product (Compound I-7) as monosodium salt crystals.

Synthesis of Compound I-11

To an aqueous hydrochloric acid solution of 7.2 g of hydrochloric acid hydroxylamine and 18 g of phosphorous acid, 32.6 g of formalin was added, and then it was heated under reflux for 2 hours. The thus obtained crystals were recrystallized by utilizing water and methanol to obtain 9.2 g (yield: 42%) of Compound I-11.

The hydrazine salts represented by the general formula (II) (hydrazines and hydrazides) are further described below.

$R^1$, $R^2$ and $R^3$ each independently represents a hydrogen atom, a substituted or unsubstituted alkyl group (preferably a $C_{1-20}$ alkyl group such as methyl, ethyl, sulfopropyl, carboxybutyl, hydroxyethyl, cyclohexyl, benzyl, phenethyl), a substituted or unsubstituted aryl group (preferably a $C_{6-20}$ aryl group such as phenyl, 2,5-dimethoxyphenyl, 4-hydroxyphenyl, 2-carboxyphenyl) or a substituted or unsubstituted heterocyclic group (preferably a $C_{1-20}$, 5- or 6-membered heterocyclic group containing at least one of oxygen, nitrogen and sulfur as a hetero atom, examples of which include a pyridine-4-yl group and N-acetylpiperidine-4-yl group).

$R^4$ represents a hydrogen atom, a hydroxyl group, a substituted or unsubstituted hydrazino group (e.g., hydrazino, methylhydrazino, phenylhydrazino), a substituted or unsubstituted alkyl group (preferably a $C_{1-20}$ alkyl group such as methyl, ethyl, sulfopropyl, carboxybutyl, hydroxyethyl, cyclohexyl, benzyl, t-butyl, n-octyl), a substituted or unsubstituted aryl group (preferably a $C_{6-20}$ aryl group such as phenyl, 2,5-dimethoxyphenyl, 4-hydroxyphenyl, 2-carboxyphenyl, 4-sulfophenyl), a substituted or unsubstituted heterocyclic group (preferably a $C_{1-20}$, 5- or 6-membered heterocyclic group containing at least one of oxygen, nitrogen and sulfur as a hetero atom, examples of which include a pyridine-4-yl group and imidazolyl group), a substituted or unsubstituted alkoxy group (preferably a $C_{1-20}$ alkoxy group such as methoxy, ethoxy, methoxyethoxy, benzyloxy, cyclohexyloxy, octyloxy), a substituted or unsubstituted aryloxy group (preferably a $C_{6-20}$ aryloxy group such as phenoxy, p-methoxyphenoxy, p-carboxyphenyl and p-sulfophenoxy), a substituted or unsubstituted carbamoyl group (preferably a $C_{1-20}$ carbamoyl group such as unsubstituted carbamoyl group, N,N-diethylcarbamoyl group and phenylcarbonyl group), or a substituted or unsubstituted amino group (preferably a $C_{0-20}$ amino group such as amino, hydroxyamino, methylamino, hexylamino, methoxyethylamino, carboxyethylamino, sulfoethylamino, N-phenylamino and p-sulfophenylamino).

Preferred examples of substituents for the groups $R^1$, $R^2$, $R^3$ and $R^4$ include halogen atom (chlorine, bromine), hydroxyl group, carboxyl group, sulfo group, amino group, alkoxy group, amide group, sulfonamide group, carbamoyl group, sulfamoyl group, alkyl group, aryl group, aryloxy group, alkylthio group, arylthio group, nitro group, cyano group, sulfonyl group, and sulfinyl group. These substituents may be further substituted.

$X^1$ is preferably a divalent organic residue. Specific examples of the divalent organic residue include —CO—, —SO—, and $$-\overset{\overset{\displaystyle NH}{\|}}{C}-.$$

The suffix n represents an integer of 0 or 1. When n is 0, $R^4$ represents a substituted or unsubstituted alkyl group, aryl group or heterocyclic group. $R^3$ and $R^4$ may combine to form a heterocyclic group. When n is 0, at least one of $R^1$ to $R^4$ is preferably a substituted or unsubstituted alkyl group. In particular, $R^1$, $R^2$, $R^3$ and $R^4$ each is preferably a hydrogen atom or substituted or unsubstituted alkyl group, with the proviso that $R^1$, $R^2$, $R^3$ and $R^4$ are not all hydrogen atoms. More preferably, $R^1$, $R^2$ and $R^3$ each represents a hydrogen atom, and $R^4$ is a substituted or unsubstituted alkyl group. Alternatively, $R^1$ and $R^2$ each represents a hydrogen atom, and $R^2$ and $R^4$ each represents a substituted or unsubstituted alkyl group. Alternatively, $R^1$ and $R^2$ each represents a hydrogen atom, and $R^3$ and $R^4$ each represents a substituted or unsubstituted alkyl group ($R^3$ and $R^4$ may together form a heterocyclic group) When n is 1, $X^1$ is preferably —CO—, $R^4$ is preferably a substituted or unsubstituted amino group, and $R^1$ to $R^3$ each is preferably a hydrogen atom or a substituted or unsubstituted alkyl group.

The integer n is preferably 0.

The alkyl groups represented by $R^1$ to $R^4$ each preferably contains 1 to 10 carbon atoms, more preferably 1 to 7 carbon atoms. Preferred examples of substituents to be contained in the alkyl group include hydroxyl group, carboxylic acid group, sulfonic acid group, and phosphonic acid group. If the alkyl group contains two or more substituents, the substituents may be the same or different.

The compound represented by the general formula (II) may form a bis compound, tris compound or polymer comprising units connected via $R^1$, $R^2$, $R^3$ and $R^4$.

Among the compounds represented by the general formula (II), those having a dissociation proton may form a salt of sodium, potassium, ammonium, lithium and other alkali metals and alkaline earth metals, etc.

Specific examples of the compound represented by the general formula (II) are set forth below, but the present invention is not be construed as being limited thereto.

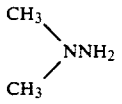

(II-1)

$CH_3NHNHCH_3$ (II-2)

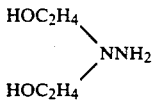

(II-3)

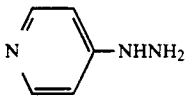

(II-4)

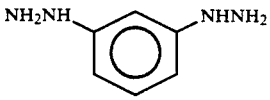

(II-5)

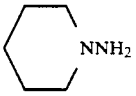

(II-6)

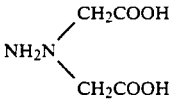

(II-7)

$HOOCCH_2NHNHCH_2COOH$ (II-8)

$NH_2NH(CH_2)_3NHNH_2$ (II-9)

$NH_2NHCH_2CH_2OH$ (II-10)

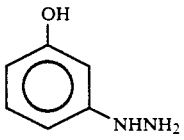

(II-11)

$NH_2NH(CH_2)_3SO_3H$ (II-12)

$NH_2NH(CH_2)_4SO_3H$ (II-13)

$NH_2NH(CH_2)_3COOH$ (II-14)

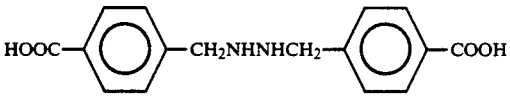

(II-15)

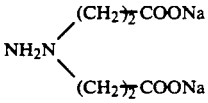

(II-16)

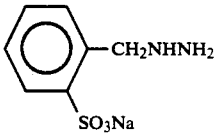

(II-17)

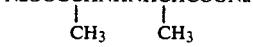

(II-18)

-continued $NH_2NHCH_2CH_2COONa$ (II-19)

$NH_2NHCH_2COONa$ (II-20)

$H_2NNHCH_2CH_2SO_3Na$ (II-21)

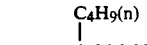

(II-22)

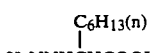

(II-23)

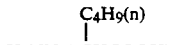

(II-24)

$H_2NN(CH_2CH_2SO_3Na)_2$ (II-25)

$H_2NN(CH_2CH_2CH_2SO_3Na)_2$ (II-26)

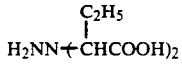

(II-27)

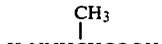

(II-28)

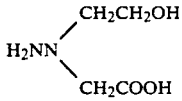

(II-29)

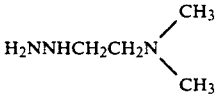

(II-30)

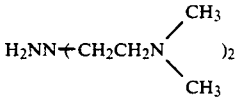

(II-31)

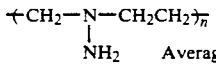

(II-32)

Average molecular weight: about 4,000

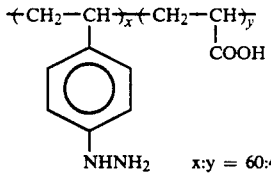

(II-33)

x:y = 60:40

Average molecular weight: about 20,000

$NH_2NHCONH_2$ (II-34)

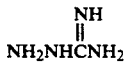

(II-35)

$NH_2NHCONHNH_2$ (II-36)

$NH_2NHSO_3H$ (II-37)

$NH_2NHSO_2NHNH_2$ (II-38)

$CH_3NHNHSO_2NHNHCH_3$ (II-39)

$NH_2NHCONH(CH_2)_3NHCONHNH_2$ (II-40)

-continued
(II-41)
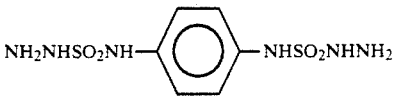
(II-42)
$NH_2NHCOCONHNH_2$
(II-43)
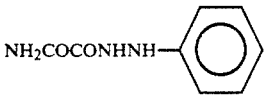
(II-44)
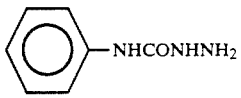
(II-45)
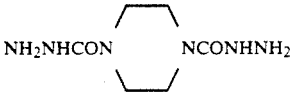
(II-46)
$NH_2COCONHNH_2$
(II-47)
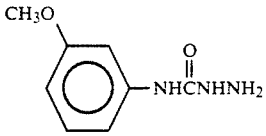
(II-48)
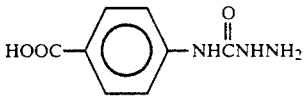
(II-49)
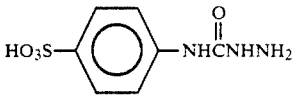
(II-50)
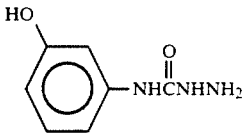
(II-51)
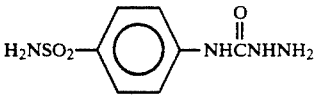
(II-52)
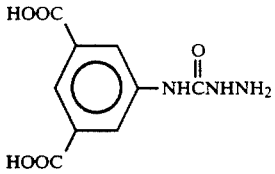
(II-53)
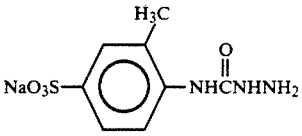
-continued
(II-54)
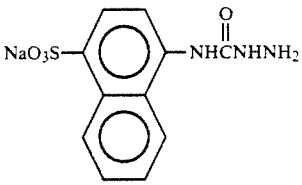
(II-55)
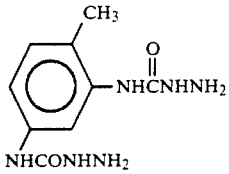
(II-56)
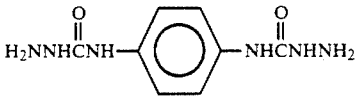
(II-57)
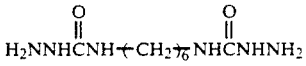
(II-58)
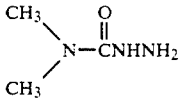
(II-59)
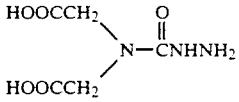
(II-60)
$NaO_3SCH_2CH_2NHC(=O)NHNH_2$
(II-61)
$HOOCCH_2CH_2NHC(=O)NHNH_2$
(II-62)
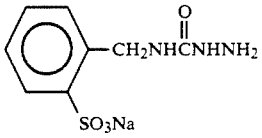
(II-63)
$NH_2NHCOOC_2H_5$
(II-64)
$NH_2NHCOCH_3$
(II-65)
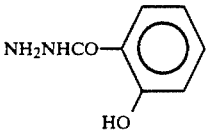
(II-66)
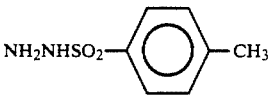
(II-67)
$NH_2NHCH_2PO_3H_2$
(II-68)
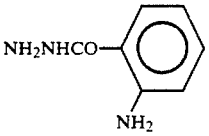

-continued (II-69)

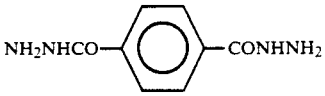

(II-70)

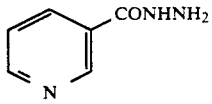

(II-71)

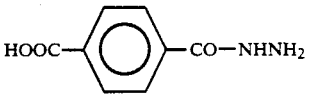

(II-72)

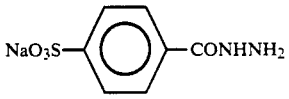

(II-73) $(CH_3)_3CCONHNH_2$ (II-74) $(CH_3)_3CC(=O)NHNH_2$ (II-75)

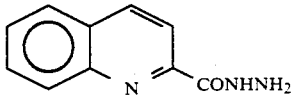

(II-76)

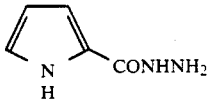

(II-77)

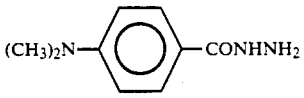

(II-78)

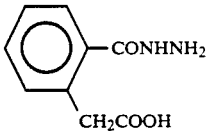

(II-79)

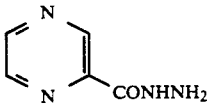

(II-80) $HOCH_2CH_2SO_2NHNH_2$ (II-81) $NaO_3SCH_2CH_2CONHNH_2$ (II-82) $H_2NCONHCH_2CH_2SO_2NHNH_2$ (II-83)

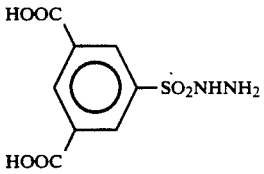

-continued (II-84)

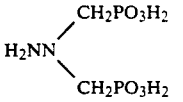

(II-85) $H_2NNHCH_2CH_2PO_3H_2$ (II-86)

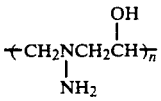

(II-87)

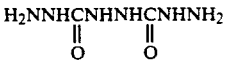

(II-88) $CH_3NHNHSO_2NHNHSO_2NHNHCH_3$

Other specific examples of the compound represented by the general formula (II) include those described in JP-A-63-146041 (Japanese Patent Application No. 61-170756, pp. 11–24), JP-A-63-146042 (Japanese Patent Application No. 61-171682, pp. 12-22), and JP-A-63-146043 (Japanese Patent Application No. 61-173468, pp. 9–19).

Many of the compounds represented by the general formula (II) are commercially available and can be synthesized in accordance with an ordinary synthesis method as described in *Organic Synthesis,* Coll. vol. 2, pp. 208–213; *Jour. Amer. Chem. Soc.,* 36, 1747(1914); *Yukagaku* (Oil Chemistry), 24, 31(1975); *Jour. Org. Chem.,* 25, 44(1960), *Yakugaku Zasshi* (Pharmaceutical Magazine), 91, 1127(1971), *Organic Synthesis,* Coll. vol.1, p. 450; *Shinjikken Kagaku Koza,* vol. 14, III, pp. 1621–1628 (Maruzen); Beil., 2, 559, Beil., 3, 117; E. B. Mohr et al., *Inorg. Syn.,* 4, 32(1953); F. L. Wilson, E. C. Pickering, *J. Chem. Soc.,* 123, 394 (1923); N. J. Leonard, J. H. Boyer, *J. Org. Chem.,* 15, 42(1950); *Organic Synthesis,* Coll. Vol. 5, p. 1055; P. A. S. Smith, "Derivatives of Hydrazine and Other Hydronitrogens Having n Bonds", pp. 120–124, pp. 130–131, THE BEBJAMIN/-CUMMING COMPANY, (1983); and Stanley R. Sandier Waif Karo, *Organic Functional Group Preparations,* Vol. 1, Second Edition, p. 457.

The addition amount of the compound represented by the general formula (I) and/or (II) is in the range of 0.01 to 50 g, preferably 0.1 to 30 g, and more preferably 0.5 to 20 g per liter of color developer.

The color developer of the present invention can also comprise preservatives other than the compounds represented by the general formulae (I) and (II) in amounts such that the effects of the present invention are not impaired. In particular, the compounds represented by the general formulae (I) and (II) are preferably used in combination with triethanolamine or catecholsulfonic acids.

In the case where a reversal process is effected, a black-and-white development process is normally followed by a color development process in accordance with the present invention. The developer to be used in the black-and-white development process can comprise known black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol), either singly or in combination.

These color developers and black-and-white developers generally have a pH value of 9 to 12.

In the present invention, a regenerant is added to used color developer (overflow liquid) for reuse as a color developer replenisher without removal of halogen components.

In general, the regenerant is added to the used color developer (overflow liquid) to compensate for the components consumed in the color development process.

In general, the regenerant added to the used color developer to obtain the color developer replenisher of the present invention preferably is an aqueous solution comprising the same type of color developing agents, pH buffers and chelating agents contained in the color developer, and optionally other components, such as preservatives, development accelerators and fluorescent brightening agents. The amount of the chemical components of the regenerator may be predetermined to resupply the components of the color developer consumed in the color development process. The content of the color developing agents, pH buffers, chelating agents and preservatives are each preferably in the range of 0.001 to 0.02 mol, 0.01 to 0.2 mol, 0.001 to 0.02 mol, and 0.01 to 0.03 mol, respectively, per liter of the replenisher thus regenerated.

The regenerant for use in the present invention is preferably free of bromide.

In the present invention, the surface area of the processing solution in contact with air is preferably minimized to inhibit the evaporation and air oxidation of the liquid. In the preparation of the color developer replenisher, water is preferably added to the color developer replenisher in an appropriate amount to make up for the concentration caused by the evaporation of the liquid developing bath.

In the method of the present invention, the color developing temperature is from 30° to 60 ° C., and preferably from 35° to 40 ° C. The processing time is in the range of 20 seconds to 4 minutes, preferably 30 seconds to 2 minutes.

The color developing bath preferably comprises one tank, but may comprise two or more tanks. In the case where a plurality of tanks are used, the color developer replenisher thus regenerated may be supplied to any of the lst tank or succeeding tanks.

The silver halide color photographic material which has been color developed in accordance with the present invention is then generally bleached. Bleaching may be effected simultaneously with fixation (e.g., blix), or these two steps may be carried out separately. For speeding up of processing, bleaching may be followed by blixing. Furthermore, any of an embodiment wherein two blix baths connected in series are used, an embodiment wherein blixing is preceded by fixation, and an embodiment wherein blixing is followed by bleaching may be selected in accordance with the intended application. Useful bleaching agents include compounds of polyvalent metals, e.g., iron (III), cobalt (III), chromium (VI), and copper (II), peracids, quinones, nitro compounds, and the like. Typical examples of these bleaching agents are ferricyanides; bichromates; organic complex salts of iron (III) or cobalt (III), such as complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc.; persulfates; hydrobromic acid salts; permanganates; nitrobenzenes; etc. Of these, aminopolycarboxylic acid-iron (III) complex salts such as (ethylenediaminetetraacetato)iron (III) complex salts and persulfates are preferred for speeding up of processing and protection of the environment. In particular, aminopolycarboxylic acid-iron (III) complex salts are useful in both the bleaching solution and blix solution. The bleaching or blix solution using the aminopolycarboxylic acid-iron generally has a pH of from 5.5 to 8. For speeding up of processing, it is possible to employ a lower pH value.

The bleaching bath, blix bath or a prebath thereof can contain, if desired, a bleaching accelerator. Examples of useful bleaching accelerators are compounds containing a mercapto group or disulfide group as described in U.S. Patent 3,893,858, West German Patent 1,290,812, JP-A-53-95630, and *Research Disclosure* No. 17129 (July, 1978), thiazolidine derivaties as described in JP-A-50-140129, thiourea derivatives as described in U.S. Pat. No. 3,706,561, iodides as described in JP-A-58-16235, polyoxyethylene compounds as described in West German Patent 2,748,430, polyamine compounds as described in JP-B-45-8836, and bromide ion. Preferred among these compounds are compounds containing a mercapto group or disulfide group due to their large accelerating effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. The bleaching accelerators may be incorporated into the light-sensitive material.

Useful fixing agents include thiosulfates, thiocyanates, thioethers, thioureas, and iodide in high concentration. Thiosulfates are generally employed, with ammonium thiosulfate being most broadly applicable. Sulfites, bisulfites, sulfinic acids or carbonyl bisulfite adducts are suitably used as preservatives of the blix bath.

In the present invention, used processing solution (overflow liquid) from the desilvering process is also preferably regenerated, the desilvering process including processing with a blix solution, bleaching solution and/or fixing solution. The regeneration of the used desilvering process solution can be accomplished by any suitable known silver ion removing method, e.g., steel wool process, as described in JP-A-48-3624 and U.S. Pat. No. 4,065,313, the electrolytic process as described in U.S. Pat. Nos. 4,014,764 and 4,036,715, JP-B-53-40491, and JP-A-61-232452, and the dilution process as described in JP-B-56-33697. In particular, a regeneration process is preferably used which comprises the addition to the overflow liquid of components which have been consumed in the used processing solution without removing accumulated components therefrom, to thereby serve as a replenisher.

Generally, the silver halide color photographic material of the present invention which has been developed and desilvered is then subjected to water washing and/or stabilization. The amount of water to be used in the water washing is selected from a broad range depending on the characteristics of the light-sensitive material (for example, the kind of couplers employed therein, etc.), the end use of the light-sensitive material, the temperature of the washing water, the number of washing tanks (number of stages), the replenishment system (e.g., countercurrent or forward system), and other various factors. Of these factors, the relationship between the number of washing tanks and the quantity of water in a multistage countercurrent system can be determined in accordance with the method as described in the *Journal*

*of the Society of Motion Picture and Television Engineers,* Vol. 64, pp. 248–253 (May, 1955).

According to the multi-stage countercurrent system described in the above cited reference, although the requisite amount of water is greatly reduced, bacteria tends to grow due to an increase of the retention time of water in the tank, and floating masses of bacteria undesirably adhere to the light-sensitive material. In the method of the present invention, the technique of reducing calcium and magnesium ion concentrations as described in JP-A-62-288838 can be used very effectively to solve this problem. Furthermore, it is also effective to use isothiazolone compounds or thiabendazoles as described in JP-A-578542, chlorine type bactericides, e.g., chlorinated sodium isocyanurate, benzotriazole, and bactericides described in Hiroshi Horiguchi, *Bokinbobaizai no kagaku,* Eisei Gijutsu Gakkai (ed.), *Biseibutsu no mekkin, sakkin, bobaigijutsu,* and Nippon Bokin Bobai Gakkai (ed.), *Bokin bobaizai jiten.*

The washing water has a pH value in the range of from 4 to 9, preferably from 5 to 8. The temperature of the water and the washing time can be selected from a broad range depending on the characteristics and end use of the light-sensitive material, but generally ranges from 15° to 45° C. and from 20 seconds to 10 minutes, and preferably from 25° to 40° C. and from 30 seconds to 5 minutes, respectively. The light-sensitive material of the present invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases. For example, a stabilizing bath containing formalin and a surface active agent may be used. This stabilizing bath may also contain various chelating agents or bactericides.

The overflow liquid accompanying replenishment of the washing bath and/or stabilizing bath can be reused in other steps such as the desilvering step.

The silver halide color photographic material of the present invention can comprise a color developing agent incorporated therein for the purpose of simplifying and speeding up the processing. The color developing agent can be incorporated in the form of precursor. Examples of useful color developing agent precursors include the indoaniline compounds as described in U.S. Pat. No. 3,342,597, the Schiff base type compounds as described in U.S. Pat. No. 3,342,599, and Research Disclosure Nos. 14850 and 15159, the aldol compounds as described in Research Disclosure No. 13924, the metallic salt complexes as described in U.S. Pat. No. 3,719,492, and the urethane compounds as described in JP-A-53-135628.

The silver halide color photographic material of the present invention may optionally comprise various 1-phenyl-3-pyrazolidones for the purpose of accelerating color development. Useful examples of such compounds are described in JP-A-56-64339, JP-A-57-144547, and JP-A-58-115438.

The various processing solutions in the present invention are used at a temperature ranging from 10° C. to 50° C. The normal standard temperature at which these processing solutions are used ranges from 33° C. to 38° C. These processing solutions can be used at a higher temperature range to reduce the processing time or at a lower temperature range to improve the image quality and the stability of the processing solutions. In order to save the amount of silver to be incorporated in the light-sensitive material, a process utilizing cobalt intensification or hydrogen peroxide intensification as described in West German Patent 2,226,770 and U.S. Pat. No. 3,674,499 can be effected.

The silver halide color photographic material for use in the present invention is described in detail below.

The silver halide emulsion for use in the color photographic material of the present invention is substantially made of silver chloride. In particular, the content of silver chloride is in the range of 95 mol % or more, and preferably 98 mol % or more based on the total weight of silver halide. In view of rapidity of processing, a higher the silver chloride content is preferred. The high silver halide content emulsion may contain a small amount of silver bromide or silver iodide to advantageously enhance light sensitivity, e.g., an increase in light absorption, or increase the adsorption of spectral sensitizing dyes, or decrease desensitization by spectral sensitizing dyes.

The silver halide for use in the photographic emulsion layer of the photographic light-sensitive material of the present invention may have a phase in which the internal layer and the surface layer differ, a multi-layer structure comprising junctions, a homogeneous phase or a mixture thereof.

The silver halide grains in the photographic emulsion may be regular grains having a regular crystal form, such as a cube, octahedron and tetradecahedron, or an irregular crystal form such as a sphere and tabular form, or a crystal defect such as a twinning plane, or a combination of these crystal forms.

The silver halide grains may be either fine grains of about 0.2 μm or smaller in diameter or large grains having a projected area diameter or up to about 10 μm, and the emulsion may be either a monodisperse emulsion having a narrow size distribution or a polydisperse emulsion having a broad size distribution.

The preparation of the silver halide photographic emulsion for use in the present invention can be accomplished by a suitable method as described in *Research Disclosure* No. 17643 (December, 1978), pp. 22–23, "I. Emulsion Preparation and Types".

Furthermore, monodisperse emulsions as described in U.S. Pat. Nos. 3,574,628 and 3,655,394 are preferably used in the present invention.

Tabular grains having an aspect ratio of about 5 or more can be used in the present invention. The preparation of such tabular grains is readily accomplished by a suitable method as described in Gutoff, *Photographic Science and Engineering,* vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, silver halides having different compositions may be connected to each other by an epitaxial junction or by any suitable compound other than silver halide, e.g., silver thiocyanate, lead oxide, etc.

Mixtures of grains having various crystal forms may also be used.

The present inventors have found that the coated amount of silver in the silver halide color photographic material of the present invention is preferably as low as possible such that the amount of halogen accumulated in the color developer is advantageously minimized. In the present invention, the coated amount of silver is preferably in the range of from 0.3 to 0.8 g, particularly 0.4 to 0.7 g per $m^2$ of light-sensitive material. If the coated amount of silver exceeds 0.8 g, an increase in the accumulated amount of halogen and fluctuation in the photographic properties (Dmin, sensitivity) occurs.

During silver halide grain formation or physical ripening, various polyvalent metallic ion impurities can be present in the system. Examples of useful compounds include salts of cadmium, zinc, lead, copper, and thallium, and salts and complex salts of the group VIII elements such as iron, ruthenium, rhodium, palladium, osmium, iridium, and platinum. Particularly preferred among these impurities are the group VIII elements. The amount of these compounds to be incorporated can have a broad range depending on the intended application. In general, the addition amount is preferably in the range of from $10^{-9}$ to $10^{-2}$ mol per mol of silver halide.

The silver halide emulsion for use in the present invention is generally subjected to physical ripening, chemical ripening and spectral sensitization. Additives to be used in these steps are described in *Research Disclosure* Nos. 17643 and 18716 as tabulated below.

Known photographic additives which can be used in the present invention are also described in the above cited two references as shown in the table below.

| Additives | RD 17643 | RD 18716 |
|---|---|---|
| 1. Chemical sensitizer | Page 23 | Right column on page 648 |
| 2. Sensitivity improver | | Right column on page 648 |
| 3. Spectral sensitizer, supersensitizer | Page 23 to page 24 | Right column on page 648 to right column on page 649 |
| 4. Brightening agent | Page 24 | |
| 5. Fog inhibitor, stabilizer | Page 24 to page 25 | Right column on page 649 |
| 6. Light absorber, filter dye, ultraviolet absorber | Page 25 to page 26 | Right column on page 649 to left column on page 650 |
| 7. Stain inhibitor | Right column on page 25 | Left column to right column on page 650 |
| 8. Dye image stabilizer | Page 25 | |
| 9. Film hardener | Page 26 | Left column on page 651 |
| 10. Binder | Page 26 | Left column on page 651 |
| 11. Plasticizer, lubricant | Page 27 | Right column on page 650 |
| 12. Coating aid, surface active agent | Page 26 to page 27 | Right column on page 650 |
| 13. Antistatic agent | Page 27 | Right column on page 650 |

Various color couplers can be used in the present invention. Specific examples of the color couplers are described in the above cited *Research Disclosure* No. 17643, VII-C to G.

Preferred yellow couplers include those described in U.S. Pat. Nos. 3,933,501, 4,022,620, 4,326,024, and 4,401,752, JP-B-58-10739, and British Patents 1,425,020 and 1,476,760.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, and JP-A-60-43659, RD Nos. 24220 (June, 1984) and 24230 (June, 1984), and WO(PCT)88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,451,559, 4,427,767, 4,690,889, 4,254,212, and 4,296,199, West German Patent Application (OLS) No. 3,329,729, European Patents 121,365A and 161,626A, and JP-A-61-42658.

Colored couplers for correction of unnecessary side absorptions of the color image dyes preferably include those described in *Research Disclosure* No. 17643, VII-G, U.S. Pat. Nos. 4,163,670, 4,004,929, and 4,138,258, JP-B-57-39413, and British Patent 1,146,368.

Couplers which form a dye having moderate diffusibility preferably include those described in U.S. Pat. No. 4,366,237, British Patent 2,125,570, European Patent 96,570, and West German Patent Application (OLS) No. 3,234,533.

Typical examples of polymerized dye forming couplers are described in U.S. Pat. Nos. 3,451,820, 4,080,211, and 4,367,282, and British Patent 2,102,173.

Couplers capable of releasing a photographically useful residue upon coupling can also be used in the present invention. Preferred examples of DIR couplers which release a developing inhibitor are described in the patents cited in RD 17643, VII-F, JP-A-57-151944, JP-A-57-154234, JP-A-60-184248, and U.S. Pat. Nos. 4,248,962.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compounds-releasing couplers as described in JP-A-60-185950, couplers capable of releasing a dye which returns to its original color after release as described in European Patent 173,302A, or the like.

The incorporation of these couplers in the light-sensitive material can be accomplished by any suitable known dispersion method.

Examples of high boiling solvents to be used in the oil-in-water dispersion process are described in U.S. Pat. No. 2,322,027.

The process and effects of the latex dispersion method and specific examples of latexes to be used for impregnation are described in U.S. Pat. No. 4,199,363, West German Patent Application (OLS) Nos. 2,541,274, and 2,541,230.

Suitable supports which can be used in the present invention are described in the above cited RD 17643 (page 28) and 18716 (right column on page 647 to left column on page 648).

The present invention is applicable to any of various types of color light-sensitive materials such as color negative films, color reversal films (coupler-in-emulsion type and coupler-in-developer type), color papers, color positive films, color reversal papers, and direct positive color light-sensitive materials, particularly preferably color papers, auto positive papers, and color reversal papers.

The present invention is further described in the following examples, but the present invention is not to be construed as being limited thereto. All parts are given by weight unless indicated otherwise.

EXAMPLE 1

Multi-layer color photographic paper specimens 1A, 1B, 1C, 1D, and 1E were prepared by coating various layers having the following compositions on a polyethylene double-laminated paper support. The emulsions used have halogen compositions as set forth in Table 1. A typical example of the coating solution was prepared as follows:

Preparation of 1st layer coating solution 19.1 g of a yellow coupler (ExY), 4.4 g of a dye image stabilizer (Cpd-1) and 0.7 g of a dye image stabilizer (Cpd-7) were dissolved in 27.2 cc of ethyl acetate and 8.2 g of a solvent (Solv-3). The solution thus obtained was then emulsification-dispersed in 185 cc of a 10% aqueous solution of gelatin containing 8 cc of 10% sodium dodecylbenzenesulfonate. On the other hand, two blue-sensitive sensitizing dyes were added to a silver chlorobromide emulsion (cubic grain with a mean grain size of 0.85 μm and grain size distribution fluctuation coefficient of 0.07) each in an amount of $2.0\times10^{-4}$ mol per mol of silver. The emulsion was then sulfur-sensitized. The emulsion dispersion previously prepared and the emulsion thus prepared were mixed and dissolved to prepare the 1st layer coating solution having the following composition. The coating solutions for the 2nd layer through the 7th layer were prepared in the same manner as described above. As a gelatin hardener for each layer the following vinylsulfonic acid compound (H-1) was used:

$$CH_2{=}CH{-}SO_2{-}CH_2\underset{\underset{O}{\|}}{C}NH{-}CH_2CH_2\underset{\underset{O}{\|}}{C}NHCH_2SO_2CH{=}CH_2 \quad \text{(H-1)}$$

As spectral sensitizing dyes for the various layers, the following compounds were used:

Blue-sensitive emulsion layer

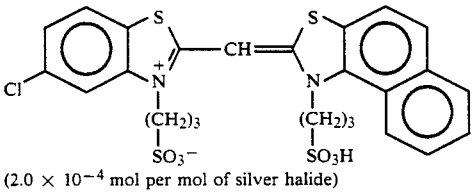

($2.0\times10^{-4}$ mol per mol of silver halide)

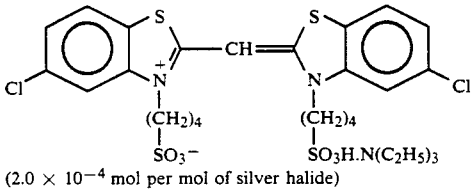

($2.0\times10^{-4}$ mol per mol of silver halide)

Green-sensitive emulsion layer

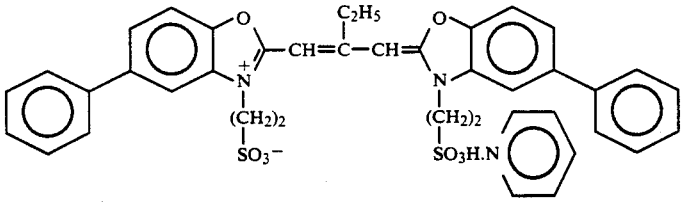

($4.0\times10^{-4}$ mol per mol of silver halide)

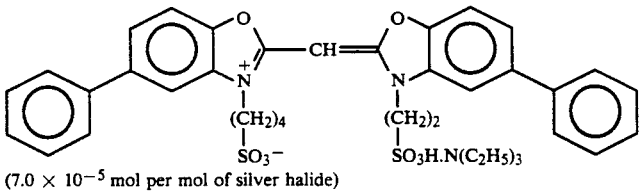

($7.0\times10^{-5}$ mol per mol of silver halide)

Red-sensitive emulsion layer

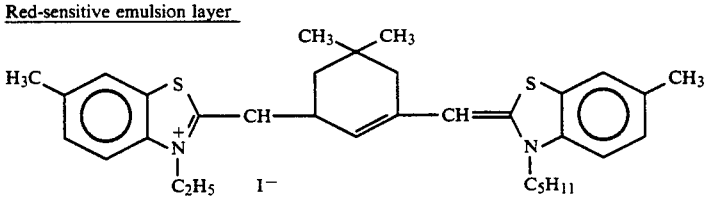

(1.2 × $10^{-4}$ mol per mol of silver halide)

The following compound was incorporated in the red-sensitive emulsion layer in an amount of $2.6\times10^{-3}$ mol per mol of silver halide.

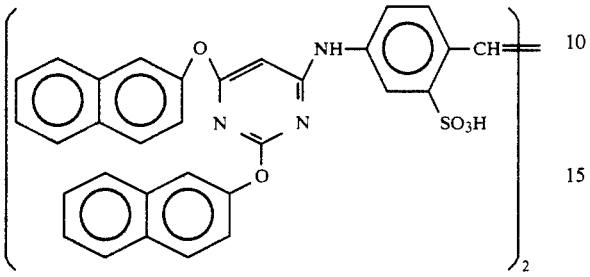

1-(5-Methylureidephenyl)-5-mercaptotetrazole was incorporated into the blue-sensitive emulsion layer, green-sensitive emulsion layer and red-sensitive emulsion layer in amounts of $8.5\times10^{-5}$ mol, $7.7\times10^{-4}$ mol and $2.5\times10^{-4}$ mol per mol of silver halide, respectively.

-continued

For the purpose of inhibiting irradiation, the following dye was incorporated into the green-sensitive emulsion layer:

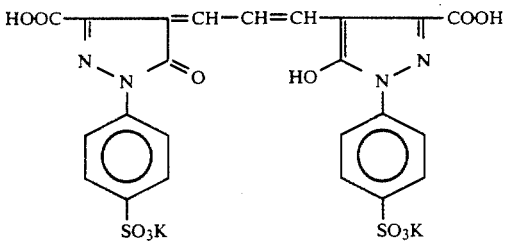

(4 mg/m²)

and the following dye was incorporated into the red-sensitive emulsion layer:

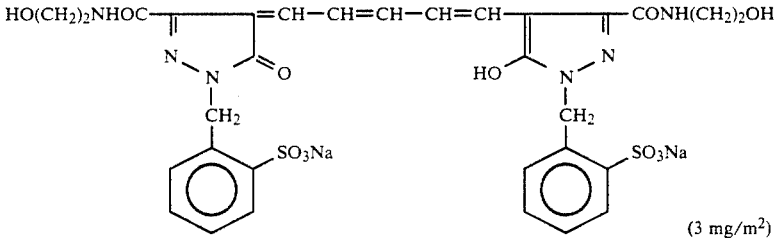

(3 mg/m²)

Layer structure

The composition of the various layers is set forth below in units of g/m². The silver halide emulsion content is given in terms of the amount of silver.

| | |
|---|---|
| Support | |
| Polyethylene-laminated paper [containing a white pigment ($TiO_2$) and a bluing dye (ultramarine) in the polyethylene layer on the side coated with the 1st layer] | |
| 1st Layer (blue-sensitive layer) | |
| Above described silver bromochloride emulsion | 0.30 |
| Gelatin | 1.86 |
| Yellow coupler (ExY) | 0.82 |
| Dye image stabilizer (Cpd-1) | 0.19 |
| Dye image stabilizer (Cpd-7) | 0.03 |
| Solvent (Solv-3) | 0.35 |
| 2nd Layer (color stain inhibiting layer) | |
| Gelatin | 0.99 |
| Color stain inhibitor (Cpd-5) | 0.08 |
| Solvent (Solv-1) | 0.16 |
| Solvent (Solv-4) | 0.08 |
| 3rd Layer (green-senstive layer) | |
| Silver chlorobromide emulsion (cubic grain with a grain size of 0.40 μm and a variation coefficient of 0.09) | 0.36 |
| Gelatin | 1.24 |
| Magenta coupler (ExM) | 0.31 |
| Dye image stabilizer (Cpd-3) | 0.12 |
| Dye image stabilizer (Cpd-4) | 0.06 |
| Dye image stabilizer (Cpd-8) | 0.09 |
| Solvent (Solv-2) | 0.42 |
| 4th Layer (ultraviolet-absorbing layer) | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| 5th Layer (red-sensitive layer) | |
| Silver chlorobromide emulsion (cubic grain with a grain size of 0.36 μm and a variation coefficient of 0.11) | 0.21 |
| Gelatin | 1.34 |

-continued

| | |
|---|---|
| Cyan coupler (ExC) | 0.34 |
| Dye image stabilizer (Cpd-6) | 0.17 |
| Dye image stabilizer (Cpd-7) | 0.34 |
| Dye image stabilizer (Cpd-9) | 0.04 |
| Solvent (Solv-6) | 0.37 |
| 6th Layer (ultraviolet-absorbing layer) | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| 7th Layer (protective layer) | |
| Gelatin | 1.33 |
| Acryl-modified copolymer of polyvinyl alcohol (modification degree: 17%) | 0.17 |
| Liquid paraffin | 0.03 |

Yellow coupler (ExY)

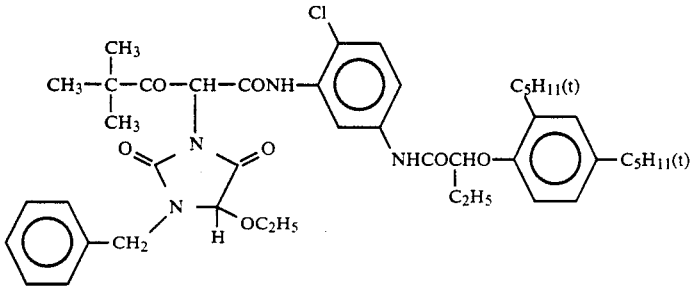

Magenta coupler (ExM)

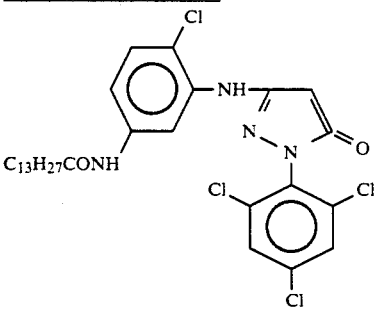

Cyan coupler (ExC)

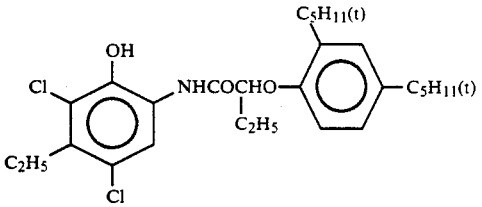

Dye image stabilizer (Cpd-1)

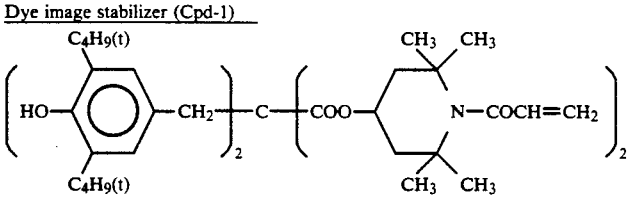

Dye image stabilizer (Cpd-3)

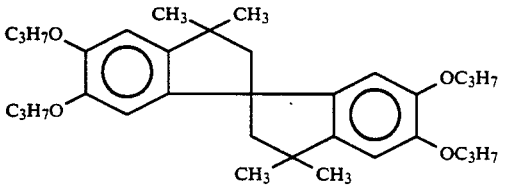

-continued
Dye image stabilizer (Cpd-4)
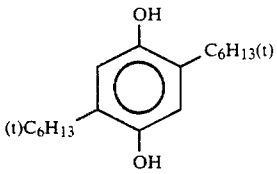
Color stain inhibitor (Cpd-5)
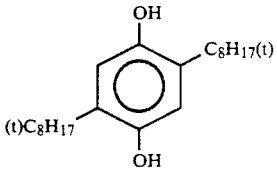
Dye image stabilizer (Cpd-6)
2:4:4 mixture (weight ratio) of:
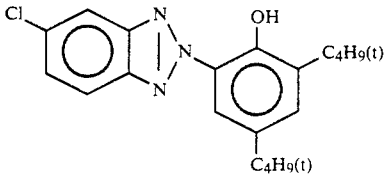
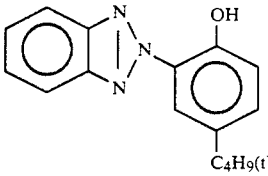
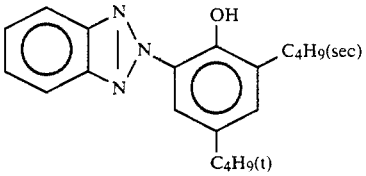
Dye image stabilizer (Cpd-7)
$$\left(CH_2-\underset{\substack{|\\ CONHC_4H_9(t)}}{CH}\right)_n$$
Average molecular weight: 60,000
Dye image stabilizer (Cpd-8)
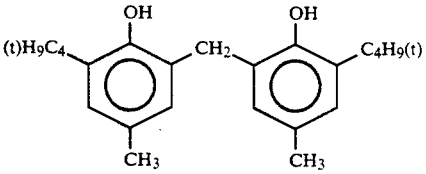
Dye image stabilizer (Cpd-9)
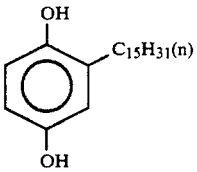
Ultraviolet absorbent (UV-1)
4:2:4 mixture (weight ratio) of:

-continued
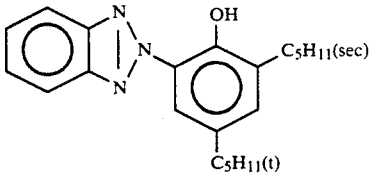
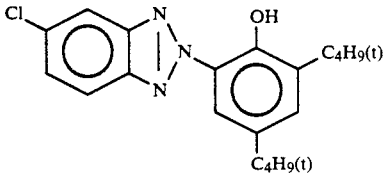
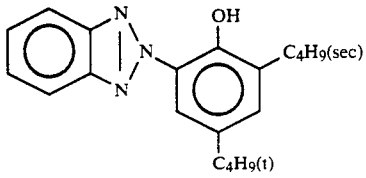
Solvent (Solv-1)
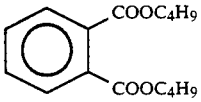
Solvent (Solv-2)
1:1 mixture (volumetric ratio) of:
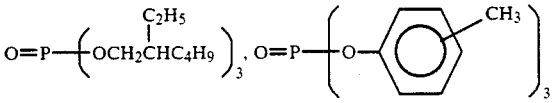
Solvent (Solv-3)
$O{=}P{+}O{-}C_9H_{19}(iso))_3$
Solvent (Solv-4)
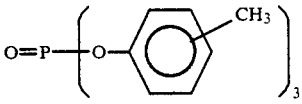
Solvent (Solv-5)
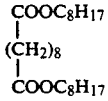
Solvent (Solv-6)
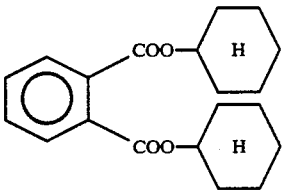

TABLE 1

| Specimen No. | (halogen composition of emulsion layers) Blue-sensitive Layer*) | Green-sensitive layer*) | Red-sensitive layer*) |
|---|---|---|---|
| 1A | 20 | 20 | 20 |
| 1B | 10 | 10 | 10 |
| 1C | 5 | 5 | 5 |
| 1D | 2 | 2 | 2 |
| 1E | 1 | 1 | 1 |

*)All the emulsion layers comprise a silver chlorobromide emulsion. The halogen composition is represented as calculated in terms of mol % of Br.

Specimens 1A to 1E thus prepared were imagewise exposed to light, and then subjected to continuous processing (running test) using the following processing steps:

| Processing Step | Temperature | Time | Replenishment Rate* | Tank Volume |
|---|---|---|---|---|
| Color development | 38° C. | 45 sec. | 161 ml | 8 l |
| Blix | 30-36° C. | 45 sec. | 215 ml | 8 l |
| Stabilization 1 | 30-37° C. | 20 sec. | — | 4 l |
| Stabilization 2 | 30-37° C. | 20 sec. | — | 4 l |
| Stabilization 3 | 30-37° C. | 20 sec. | — | 4 l |
| Stabilization 4 | 30-37° C. | 30 sec. | 248 ml | 4 l |
| Drying | 70-85° C. | 60 sec. | | |

*per $m^2$ of light-sensitive material
(The stabilization step was effected in a countercurrent process in which the processing solution flows in a direction opposite the processing sequence.)

The composition of the various processing solutions are as follows:

| | Running Solution | Replenisher |
|---|---|---|
| **Color developer** | | |
| Water | 800 ml | 800 ml |
| Diethylenetriamine-pentaacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 3.2 g | — |
| Potassium carbonate | 25 g | 25 g |
| N-ethyl-N-(β-methansulfonamideethyl)-3-methyl-4-aminoaniline sulfate | 5.0 g | 7.0 g |
| Diethylhydroxylamine (4,4'-diaminostilbene series) | 2.0 g | 2.5 g |
| Potassium bromide | 0.02 g | — |
| Water to make | 1,000 ml | 1,000 ml |
| pH (25° C.) | 10.05 | 10.45 |
| **Blix solution** | | |
| Water | 400 ml | same as running solution |
| 70% Ammonium thiosulfate | 100 ml | same as running solution |
| Sodium sulfite | 17 g | same as running solution |
| Ferric (III) ammonium ethylenediamine-tetraacetate | 55 g | same as running solution |
| Disodium ethylenediamine-tetraacetate | 5 g | same as running solution |
| Glacial acetic acid | 9 g | same as running solution |
| Water to make | 1,000 ml | same as running solution |
| pH (25° C.) | 5.40 | same as running solution |
| **Stabilizing solution** | | |
| Formalin-sulfurous acid adduct | 0.7 g | same as running solution |
| 5-Chloro-2-methyl-4-isothiazoline-3-one | 0.02 g | same as running solution |
| 2-Methyl-4-isothiazoline-3-one | 0.01 g | same as running solution |
| Copper sulfate | 0.005 g | same as running solution |
| 25% Aqueous ammonia | 1.0 ml | same as running solution |
| Water to make | 1,000 ml | same as running solution |
| pH (25° C.) | 6.0 | same as running solution |

In the above described continuous processing, the amount of the processing solution carried over to the successive baths per $m^2$ of light-sensitive material was 60 ml.

The overflow liquid from the color developing bath was collected to obtain a stock solution. When the replenisher had been supplied in an amount of 16 liter, the collected (stocked) amount of the replenisher reached 9.8 liter.

The following chemicals were than added to 9.8 liter of the stock solution. Water was then added to the stock solution to make 16 liter. The stock solution thus regenerated was reused as the replenisher.

| | |
|---|---|
| Stock solution | 9.8 l |
| Diethylenetriaminepentaacetic acid | 12 g |
| 5,6-dihydroxybenzene-1,2,4 trisulfonic acid | 1.86 g |
| Triethanolamine | 50 g |
| Potassium carbonate | 150 g |
| N-ethyl-N-[β-methanesulfonamideethyl]-3-methyl-4-aminoaniline sulfate | 60 g |
| Diethylhydroxylamine | 58 g |
| Fluorescent brightening agent | 20 g |
| Water to make | 16 l |
| pH adjusted with KOH to | 10.45 |

The above described regeneration was repeated 20 times for each of Specimens 1A to 1E. The round number was 40. Further, the reuse of the stock solution was conducted at the regenerating rate of 100%. At the beginning and the end of each running test, the specimens which had been imagewise exposed with a step wedge to light were processed. The change in yellow, magenta and cyan minimum density (Dmin) and maximum density (Dmax) were measured. The results are set forth in Table 2.

TABLE 2

| Specimen | ΔDmin Y | ΔDmin M | ΔDmin C | ΔDmax Y | ΔDmax M | ΔDmax C |
|---|---|---|---|---|---|---|
| 1A | +0.08 | +0.05 | +0.02 | −0.30 | −0.15 | −0.15 |
| 1B | +0.06 | +0.04 | +0.01 | −0.25 | −0.10 | −0.09 |
| 1C | +0.03 | +0.01 | 0 | −0.05 | −0.02 | −0.02 |
| 1D | +0.01 | 0 | 0 | +0.02 | 0 | +0.02 |

TABLE 2-continued

| Specimen | ΔDmin | | | ΔDmax | | |
|---|---|---|---|---|---|---|
| | Y | M | C | Y | M | C |
| 1E | +0.01 | 0 | 0 | +0.04 | +0.03 | +0.02 |

The specimens in accordance with the present invention (1C, 1D, 1E) exhibited a small change in Dmin and Dmax after running processing and provided excellent photographic properties. On the other hand, comparative Specimens 1A and 1B are disadvantageous in that they exhibited a marked rise in Dmix and large decrease in Dmax.

In particular, Specimens 1D and 1E, which had a Br content of 2% or less (i.e., AgCl content of 98 mol % or more), provided excellent results.

EXAMPLE 2

Multi-layer color photographic paper specimens 2A and 2B were prepared by coating various layers having the following structures on a polyethylene double-laminated paper support which had been treated with corona-discharge. The halogen composition of the emulsions used are set forth below. The coating solutions for the various layers were prepared as follows:

Preparation of 1st layer coating solution 60.0 g of a yellow coupler (ExY-2) and 28.0 g of a discoloration inhibitor (Cpd-21) were dissolved in 150 cc of ethyl acetate, 1.0 cc of a solvent (Solv-23) and 3.0 cc of a solvent (Solv-24). The solution thus obtained was then added to 450 cc of a 10% aqueous solution of gelatin containing sodium dodecylbenzenesulfonate. The mixture was then subjected to dispersion in an ultrasonic homogenizer. The dispersion thus obtained was then dissolved in 420 g of a silver chlorobromide emulsion containing the following blue-sensitive sensitizing dye to prepare the 1st layer coating solution.

The coating solutions for the 2nd layer to the 7th layer were prepared in the same manner as described above. The gelatin hardener 1,2-bis(vinylsulfonyl)ethane was used in each layer.

As spectral sensitizing dyes for the various layers, the following compounds were employed.

| | |
|---|---|
| Blue-sensitive emulsion layer: | Anhydro-5,5'-dichloro-3,3'-disulfoethylthiacyanine-hydroxide |
| Green-sensitive emulsion layer: | Anhydro-9-ethyl-5,5'-diphenyl-3,3'-disulfo-ethyloxacarbocyanine-hydroxide |
| Red-sensitive emulsion layer: | 3,3'-Diethyl-5-methoxy-9,11-neopentylthiadi-carbocyanine iodide |

As a stabilizer for each emulsion layer a 7:2:1 mixture (molar ratio) of 1(2-acetamino-phenyl)-5-mercaptotetrazole, 1-phenyl-5-mercaptotetrazole, and 1-(p-methoxyphenyl)-5-mercaptotetrazole was used.

As anti-irradiation dyes, the following compounds was used.

Disodium [3-Carboxy-5-hydroxy-4-(3-(3-carboxy-5-oxo-1-(2,5-bisulfonatophenyl)-2-pyrazoline-4-ylidene)-1-propenyl)-1-pyrazolyl]benzene-2,5-disulfonate; tetrasodium N,N'-(4,8-dihydroxy-9,10-dioxo-3,7-disulfonatoanthracene-1,5-diyl)bis(aminomethanesulfonate); Sodium [3-cyano-5-hydroxy-4-(3-(3-cyano-5-oxo-1-(4-sulfonatophenyl)-2-pyrazoline-4-ylidene)-1-pentanyl)-1-pyrazolyl]benzene-4-sulfonate

Layer structure

The composition of the various layers is set forth below in units g/m$^2$. The silver halide emulsion content is given in terms of the amount of silver.

Support

Paper support obtained by corona-discharge of the surface of a polyethylene double-laminated paper

| | |
|---|---|
| 1st Layer (blue-sensitive layer) | |
| Silver chlorobromide emulsion as described above (cubic grain with a mean grain size of 0.9 μm) | 0.29 |
| Gelatin | 1.80 |
| Yellow coupler (ExY-2) | 0.60 |
| Discoloration inhibitor (Cpd-21) | 0.28 |
| Solvent (Solv-23) | 0.01 |
| Solvent (Solv-24) | 0.03 |
| 2nd Layer (color stain inhibiting layer) | |
| Gelatin | 0.80 |
| Color stain inhibitor (Cpd-22) | 0.055 |
| Solvent (Solv-21) | 0.03 |
| Solvent (Solv-22) | 0.015 |
| 3rd Layer (green-sensitive layer) | |
| Silver chlorobromide emulsion as described above (cubic grain with a mean size of 0.45 μm) | 0.25 |
| Gelatin | 1.86 |
| Magenta coupler (ExM-2) | 0.27 |
| Discoloration inhibitor (Cpd-23) | 0.17 |
| Discoloration inhibitor (Cpd-24) | 0.10 |
| Solvent (Solv-21) | 0.2 |
| Solvent (Solv-22) | 0.03 |
| 4th Layer (color stain inhibiting layer) | |
| Gelatin | 1.70 |
| Color stain inhibitor (Cpd-22) | 0.065 |
| Ultraviolet absorbent (UV-21) | 0.45 |
| Ultraviolet absorbent (UV-22) | 0.23 |
| Solvent (Solv-21) | 0.05 |
| Solvent (Solv-22) | 0.05 |
| 5th Layer (red-sensitive layer) | |
| Silver chlorobromide emulsion as described above (cubic grain with a | 0.21 |

-continued

| | |
|---|---|
| mean grain size of 0.5 μm) | |
| Gelatin | 1.80 |
| Cyan coupler (ExC-21) | 0.26 |
| Cyan coupler (ExC-22) | 0.12 |
| Discoloration inhibitor (Cpd-21) | 0.20 |
| Solvent (Solv-21) | 0.16 |
| Solvent (Solv-22) | 0.09 |
| Color development accelerator (Cpd-25) | 0.15 |
| 6th Layer (ultraviolet absorbing layer) | |
| Gelatin | 0.70 |
| Ultraviolet absorbent (UV-21) | 0.26 |
| Ultraviolet absorbent (UV-22) | 0.07 |
| Solvent (Solv-21) | 0.30 |
| Solvent (Solv-22) | 0.09 |
| 7th Layer (protective layer) | |
| Gelatin | 1.07 |

(ExY-2)

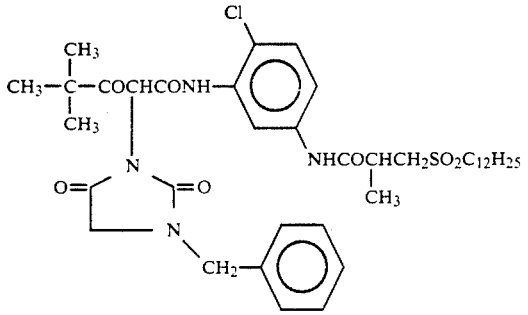

(ExM-2)

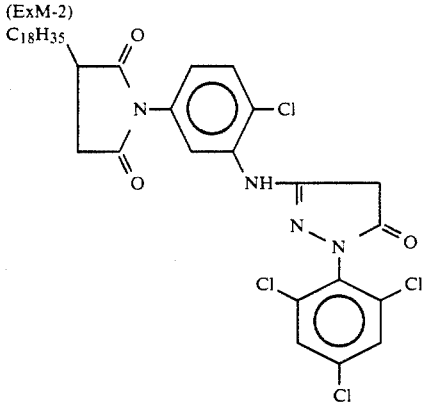

(ExC)

ExC-21

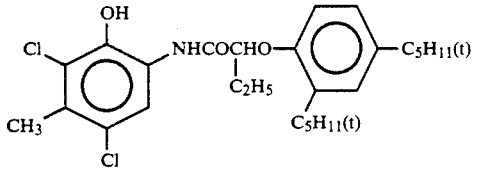

ExC-22

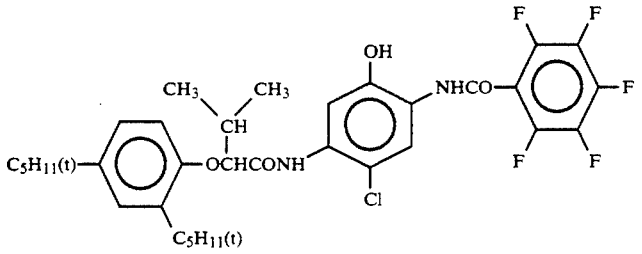

Discoloration inhibitor (Cpd-21)

-continued $$\left(CH_2-\underset{\substack{|\\ CONHC_4H_9(n)}}{CH}\right)_n$$

Average molecular weight: 80,000
Discoloration inhibitor (Cpd-22)
2,5-Di-tert-octylhydroquinone
Discoloration inhibitor (Cpd-23)
7,7'-Dihydroxy-4,4,4',4'-tetramethyl-2,2'-spirochroman
Discoloration inhibitor (Cpd-24)
N-(4-dodecyloxyphenyl)-morpholine
Color development accelerator (Cpd-25)
p-(p-Toluenesulfonamide)phenyl-dodecane
Solvent (Solv-21)
Di(2-ethylhexyl)phthalate
Solvent (Solv-22)
Dibutyl phthalate
Solvent (Solv-23)
Di(i-nonyl)phthalate
Solvent (Solv-24)
N,N-diethylcarbonamide-methoxy-2,4-di-t-amylbenzene
Ultraviolet absorbent (UV-21)
2-(2-Hydroxy-3,5-di-tert-amylphenyl)benzotriazole
Ultraviolet absorbent (UV-22)
2-(2-Hydroxy-3,5-di-tert-butylphenyl)benzotriazole In Specimen 2A, a silver chlorobromide emulsion having a Cl content of 90 mol % was incorporated into each layer.

In Specimen 2B, a silver chlorobromide emulsion having a Cl content of 99 mol % was incorporated into each layer.

The thus prepared specimens were imagewise exposed to light, and then subjected to continuous processing (running test) using the following processing steps:

| Processing Step | Temperature | Time | Replenishment Rate* | Tank Volume |
|---|---|---|---|---|
| Color development | 38° C. | 45 sec. | 161 ml | 10 l |
| Blix | 30–36° C. | 45 sec. | 215 ml | 10 l |
| Stabilization 1 | 30–37° C. | 20 sec. | — | 5 l |
| Stabilization 2 | 30–37° C. | 20 sec. | — | 5 l |
| Stabilization 3 | 30–37° C. | 20 sec. | 300 ml | 5 l |
| Drying | 70–85° C. | 60 sec. | | |

*per $m^2$ of light-sensitive material
(The stabilization step was effected in a countercurrent process in which the processing solution flows in a direction opposite the processing sequence.)

The composition of the various processing solutions was as follows:

| | Running Solution | Replenisher |
|---|---|---|
| **Color developer** | | |
| Water | 800 ml | 800 ml |
| Ethylenediamine-N,N,N',N' tetramethylenephosphonic acid | 3.0 g | 3.0 g |
| Potassium bromide | 0.02 g | — |
| Potassium chloride | 3.0 g | — |
| Fluorescent brightening agent (4,4'-diaminostilbene series) | 2.0 g | 2.5 g |
| Potassium carbonate | 25 g | 25 g |
| Triethanolamine | 10 g | 10 g |
| Diethylhydroxylamine | 4.2 g | 6.0 g |
| N-ethyl-N-(β-methanesulfonamideethyl)-3-methyl-4-aminoaniline sulfate | 5.0 g | 7.0 g |
| Water to make | 1,000 ml | 1,000 ml |
| pH (25° C.) | 10.05 | 10.45 |
| **Blix solution** | | |
| Water | 400 ml | same as running solution |
| 70% Ammonium thiosulfate | 100 ml | same as running solution |
| Sodium sulfite | 17 g | same as running solution |
| Ferric (III) ammonium ethylenediaminetetraacetate | 55 g | same as running solution |
| Disodium ethylenediaminetetraacetate | 5 g | same as running solution |
| Ammonium bromide | 20 g | same as running solution |
| Glacial acetic acid | 9 g | same as running solution |
| Water to make | 1,000 ml | same as running solution |
| pH (25° C.) | 5.40 | same as running solution |

Washing water

Ion-exchanged water with calcium and magnesium ion concentrations of 3 ppm.

The specimens were then subjected to running test with the extent of pressure applied by the squeeze rollers between the color developer and the blix solution tanks properly adjusted and the amount of color developer carried over adjusted to 25 ml/$m^2$, 45 ml/$m^2$, and 90 ml/$m^2$.

The overflow liquid from the color developing bath was collected to obtain a stock solution as conducted in Example 1. When the replenisher was supplied in an amount of 20 liter, the following chemicals (regenerants) (Regeneration A–C) were then added to the stock solution. The stock solution thus regenerated was reused as the replenisher.

Regeneration A: Amount carried over: 25 ml/$m^2$

The following chemicals were added to 16.7 liter of the stock solution. Water was then added to the stock solution to make 20 liter. The stock solution was reused as the replenisher.

| | |
|---|---|
| Ethylenediamine-N,N,N',N'-tetramethylenephosphonic acid | 10 g |
| Fluorescent brightening agent (4,4'-diaminostilbene series) | 17 g |
| Potassium carbonate | 80 g |
| Triethanolamine | 33 g |
| Diethylhydroxylamine | 50 g |
| N-ethyl-N-(β-methanesulfonamideethyl)-3-methyl-4-aminoaniline sulfate | 55 g |
| Water to make | 20.0 l |
| pH (25° C.) adjusted with KOH to | 10.45 |

Regeneration B: Amount carried over: 45 ml/m²

The following chemicals were added to 14.2 liter of the stock solution. Water was then added to the stock solution to make 20 liter. The stock solution was reused as the replenisher.

| | |
|---|---|
| Ethylenediamine-N,N,N',N'-tetramethylenephosphonic acid | 17 g |
| Fluorescent brightening agent (4,4'-diaminostilbene series) | 22 g |
| Potassium carbonate | 140 g |
| Triethanolamine | 55 g |
| Diethylhydroxylamine | 60 g |
| N-ethyl-N-(β-methanesulfonamideethyl)-3-methyl-4-aminoaniline sulfate | 55 g |
| Water to make | 20.0 l |
| pH (25° C) adjusted with KOH to | 10.45 |

Regeneration C: Amount carried over: 90 ml/m²

The following chemicals were added to 8.6 liter of the stock solution. Water was then added to the stock solution to make 20 liter. The stock solution was reused as replenisher.

| | |
|---|---|
| Ethylenediamine-N,N,N',N'-tetramethylenephosphonic acid | 34 g |
| Fluorescent brightening agent (4,4'-diaminostilbene series) | 33 g |
| Potassium carbonate | 27 g |
| Triethanolamine | 115 g |
| Diethylhydroxylamine | 84 g |

-continued

| | |
|---|---|
| N-ethyl-N-(β-methanesulfonamideethyl)-3-methyl-4-aminoaniline sulfate | 96 g |
| Water to make | 20.0 l |
| pH (25° C.) adjusted with KOH to | 10.45 |

The above described regeneration was repeated 20 times (round number being 40) for each processing. At the beginning and the end of each running test, the specimens which had been imagewise exposed to light with a step wedge were processed. The change in (Dmin) and maximum density (Dmax) were measured. In the regeneration, the regenerating rate was 100%. The results are set forth in Table 3.

TABLE 3

| Specimen | Regeneration (amount carried over ml/m²) | ΔDmin Y | ΔDmin M | ΔDmin C | ΔDmax Y | ΔDmax M | ΔDmax C | Remarks |
|---|---|---|---|---|---|---|---|---|
| 2A (Cl 90 mol %) | A (25) | +0.04 | +0.02 | +0.01 | −0.35 | −0.25 | −0.14 | (comparative) |
| | B (45) | +0.05 | +0.03 | +0.01 | −0.30 | −0.20 | −0.11 | " |
| | C (90) | +0.06 | +0.04 | +0.02 | −0.24 | −0.15 | −0.07 | " |
| 2B (Cl 99 mol %) | A (25) | +0.01 | +0.01 | 0 | −0.10 | −0.05 | −0.05 | (present invention) |
| | B (45) | +0.01 | 0 | 0 | +0.02 | +0.02 | +0.02 | (present invention) |
| | C (90) | +0.03 | +0.02 | +0.01 | +0.03 | +0.02 | +0.02 | (present invention) |

The Specimens of the present invention exhibited a small change in Dmin and Dmax and excellent running properties. In particular, excellent results were obtained in Regeneration B wherein the amount carried over was 45 ml/m².

EXAMPLE 3

Specimen 2C was prepared in the same manner as in Specimen 2A of Example 2 except that the amount of silver halide as calculated in terms of the amount of silver was modified as shown in Table 4. Specimens 2D, 2E, and 2F were prepared in the same manner as in Specimen 2B of Example 2 except that the coated amount was modified as shown in Table 4, respectively. The specimens thus prepared were then subjected to a running test in the same manner as in Regeneration B (amount carried over: 45 ml/m²) of Example 2 to determine the change in photographic properties. The round number and the regenerating rate were 40 and 100%, respectively. The results are set forth in Table 5.

TABLE 4

| Specimen | Halogen composition (Cl %) | (coated amount of silver in each layer) 1st layer (g/m²) | 3rd layer (g/m²) | 5th layer (g/m²) | Total (g/m²) |
|---|---|---|---|---|---|
| 2A | 90 | 0.29 | 0.25 | 0.21 | 0.75 |
| 2B | 99 | 0.29 | 0.25 | 0.21 | 0.75 |
| 2C | 90 | 0.29 | 0.30 | 0.26 | 0.85 |
| 2D | 99 | 0.29 | 0.30 | 0.26 | 0.85 |
| 2E | 99 | 0.24 | 0.25 | 0.21 | 0.70 |
| 2F | 99 | 0.21 | 0.21 | 0.21 | 0.63 |

TABLE 5

| Specimen No. | Halogen Composition | Total coated amount of silver (g/m²) | Remarks | ΔDmin Y | ΔDmin M | ΔDmin C | ΔDmax Y | ΔDmax M | ΔDmax C |
|---|---|---|---|---|---|---|---|---|---|
| 2A | 90% | 0.75 | Comparative | +0.05 | +0.03 | +0.01 | −0.30 | −0.20 | −0.11 |
| 2B | 99% | 0.75 | Present invention | +0.01 | 0 | 0 | +0.02 | +0.02 | +0.02 |

TABLE 5-continued

| Specimen | | | | ΔDmin | | | ΔDmax | | |
|---|---|---|---|---|---|---|---|---|---|
| No. | Halogen Composition | Total coated amount of silver (g/m²) | Remarks | Y | M | C | Y | M | C |
| 2C | 90% | 0.85 | Comparative | +0.05 | +0.03 | +0.01 | −0.32 | −0.21 | −0.11 |
| 2D | 99% | 0.85 | Present invention | +0.02 | +0.01 | 0 | −0.09 | −0.05 | −0.05 |
| 2E | 99% | 0.70 | Present invention | 0 | 0 | 0 | +0.02 | 0 | 0 |
| 2F | 99% | 0.63 | Present invention | 0 | 0 | 0 | +0.01 | 0 | 0 |

The specimens 2B, 2D, 2E and 2F of the present invention exhibited a small change in photographic properties after running processing. In particular, the specimens 2B, 2E and 2F of the coated silver amount of not more than 0.8 g/m² provided more excellent results in photographic properties.

EXAMPLE 4

A multi-layer color photographic paper specimen I was prepared by coating various layers having the following compositions on a polyethylene double-laminated paper support. A typical example of the coating solutions was prepared as follows:

Preparation of 1st layer coating solution 19.1 g of a yellow coupler (ExY-4), 4.4 g of a dye image stabilizer (Cpd-41) and 0.7 g of a dye image stabilizer (Cpd-47) were dissolved in 27.2 cc of ethyl acetate and 8.2 g of a solvent (Solv-43). A first solution thus obtained was then emulsion-dispersed in 185 cc of a 10% aqueous solution of gelatin containing 8 cc of 10% sodium dodecylbenzenesulfonate. On the other hand, two blue-sensitive sensitizing dyes were added to a second silver chlorobromide emulsion (cubic grain with a mean grain size of 0.85 μm and grain size distribution fluctuation coefficient of 0.07, comprising 0.5 mol % of silver bromide localized on part of surface thereof) each in an amount of $2.0\times10^{-4}$ mol per mol of silver. The emulsion was then sulfur-sensitized. The first prepared emulsion dispersion and the second prepared emulsion were mixed and dissolved to obtain a 1st layer coating solution having the following composition. The Coating solutions for the 2nd layer to the 7th layer were prepared in the same manner as mentioned above. As gelatin hardener for each layer, the sodium salt of 1-oxy-3,5-dichloro-s-triazine was used.

As spectral sensitizing dyes for the various layers, the following compounds were used:

Blue-sensitive emulsion layer

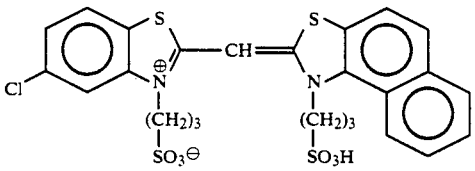

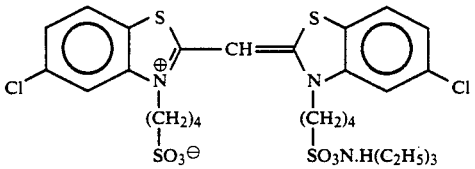

($2.5\times10^{-4}$ mol of each dye per mol of silver halide)

Green-sensitive emulsion layer

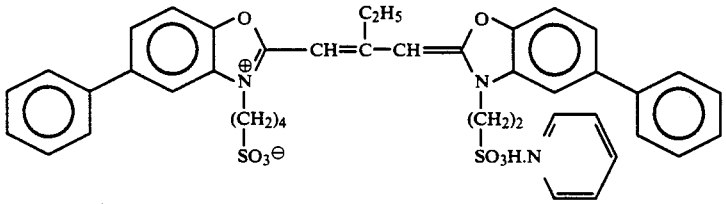

($5.0\times10^{-4}$ mol per mol of silver halide)

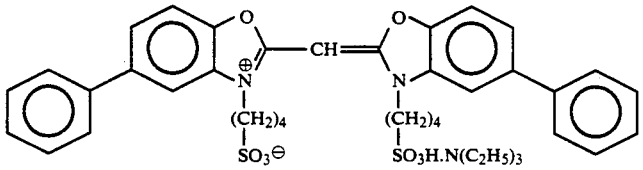

-continued ($8.0 \times 10^{-5}$ mol per mol of silver halide)

Red-sensitive emulsion layer

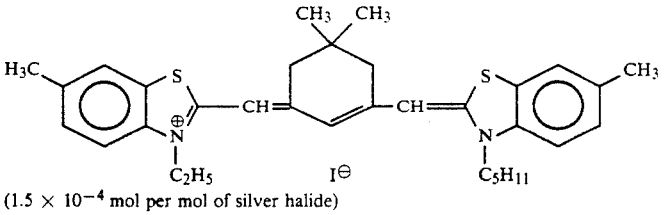

($1.5 \times 10^{-4}$ mol per mol of silver halide)

The following compound was incorporated in the red-sensitive emulsion layer in an amount of $3.0 \times 10^{-3}$ mol per mol of silver halide.

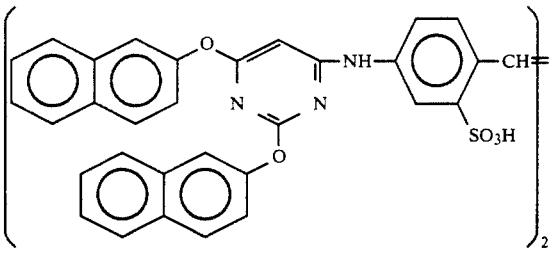

1-(5-Methylureidophenyl)-5-mercaptotetrazole was incorporated into the blue-sensitive emulsion layer, green-sensitive emulsion layer and red-sensitive emulsion layer in amounts of $9.0 \times 10^{-5}$ mol, $7.7 \times 10^{-4}$ mol and $2.5 \times 10^{-4}$ mol per mol of silver halide, respectively.

For the purpose of inhibiting irradiation, the following dyes were incorporated into the emulsion layer.

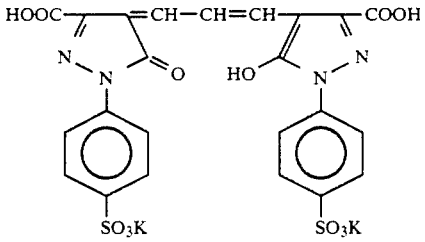

and

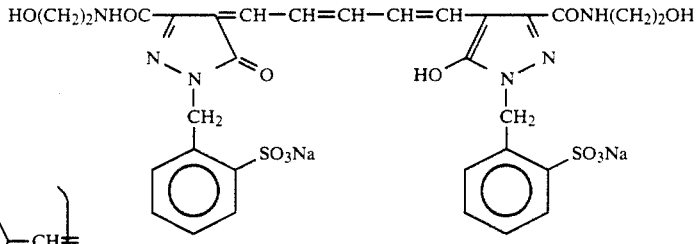

Layer structure

The composition of the various layers is set forth below in units of g/m². The silver halide emulsion content is represented in terms of the amount of silver.

| | |
|---|---|
| Support | |
| Polyethylene-laminated paper [containing a white pigment ($TiO_2$) and a bluing dye (ultramarine) in the polyethylene layer on the side coated with the 1st layer] | |
| 1st layer (blue-sensitive layer) | |
| Above described silver chlorobromide emulsion | 0.25 |
| Gelatin | 1.86 |
| Yellow coupler (ExY-4) | 0.82 |
| Dye image stabilizer (Cpd-41) | 0.19 |
| Dye image stabilizer (Cpd-47) | 0.03 |
| Solvent (Solv-43) | 0.35 |
| 2nd Layer (color stain inhibiting layer) | |
| Gelatin | 0.99 |
| Color stain inhibitor (Cpd-45) | 0.08 |
| Solvent (Solv-41) | 0.16 |
| Solvent (Solv-44) | 0.08 |
| 3rd Layer (green-sensitive layer) | |

-continued

| | |
|---|---|
| Silver chlorobromide emulsion (cubic grain with a grain size of 0.40 μm and a fluctuation coefficient of 0.09, comprising 0.5 mol % of silver bromide localized on part of the surface thereof) | 0.25 |
| Gelatin | 1.24 |
| Magenta coupler (ExM-4) | 0.31 |
| Dye image stabilizer (Cpd-43) | 0.12 |
| Dye image stabilizer (Cpd-44) | 0.06 |
| Dye image stabilizer (Cpd-48) | 0.09 |
| Solvent (Solv-42) | 0.42 |
| 4th Layer (ultraviolet-absorbing layer) | |
| Gelatin | 1.58 |
| Ultraviolet absorbent (UV-41) | 0.47 |
| Color stain inhibitor (Cpd-45) | 0.05 |
| Solvent (Solv-45) | 0.24 |
| 5th Layer (red-sensitive layer) | |
| Silver chlorobromide emulsion (cubic grain with a grain size of 0.36 μm and a fluctuation coefficient of 0.11, comprising 1.0 mol % of silver bromide localized on part of the surface thereof) | 0.21 |
| Gelatin | 1.34 |
| Cyan coupler (ExC-4) | 0.34 |
| Dye image stabilizer (Cpd-46) | 0.17 |
| Dye image stabilizer (Cpd-47) | 0.34 |
| Dye image stabilizer (Cpd-49) | 0.04 |
| Solvent (Solv-46) | 0.37 |
| 6th Layer (ultraviolet-absorbing layer) | |
| Gelatin | 0.53 |
| Ultraviolet absorbent (UV-41) | 0.16 |
| Color stain inhibitor (Cpd-45) | 0.02 |
| Solvent (Solv-45) | 0.08 |
| 7th Layer (protective layer) | |
| Gelatin | 1.33 |
| Acryl-modified copolymer of polyvinyl alcohol (modification degree: 17%) | 0.17 |
| Liquid paraffin | 0.03 |

Yellow coupler (ExY-4)

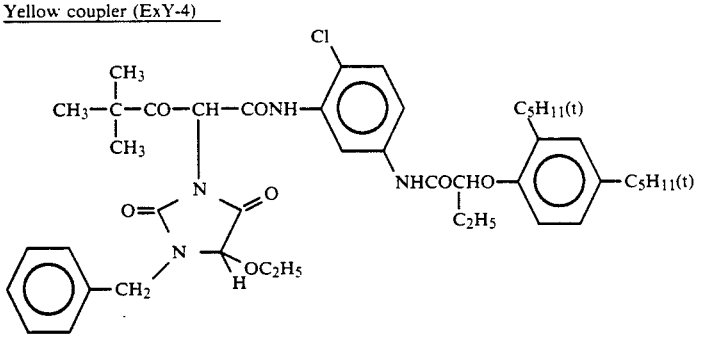

Magenta coupler (ExM-4)

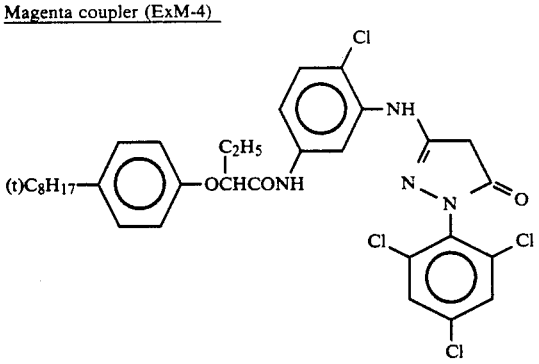

Cyan coupler (ExC-4)

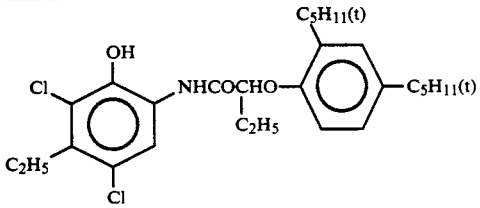

-continued
Dye image stabilizer (Cpd-41)
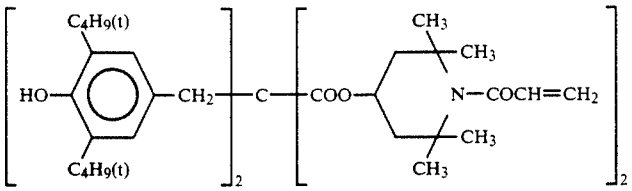
Dye image stabilizer (Cpd-43)
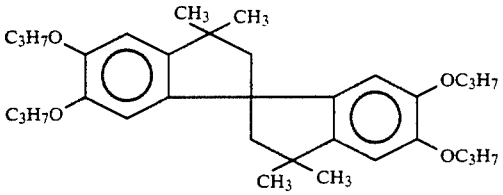
Dye image stabilizer (Cpd-44)
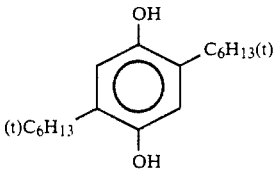
Color stain inhibitor (Cpd-45)
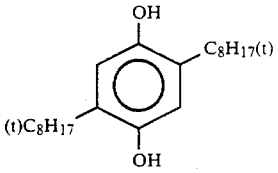
Dye image stabilizer (Cpd-46)
2:4:4 mixture (weight ratio) of:
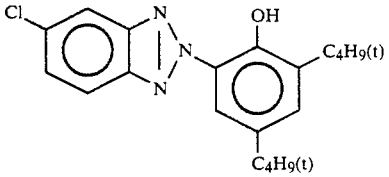
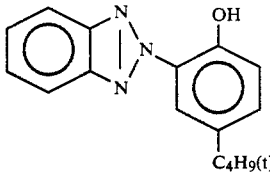
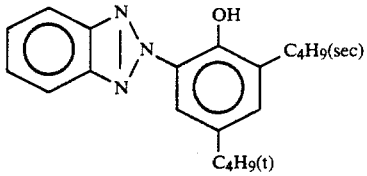
Dye image stabilizer (Cpd-47)
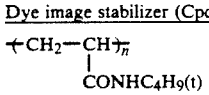
Average molecular weight: 60,000
Dye image stabilizer (Cpd-48)

-continued
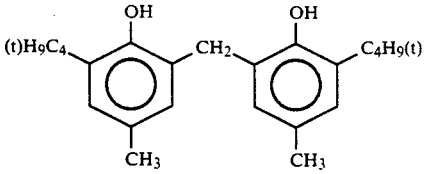
Dye image stabilizer (Cpd-49)
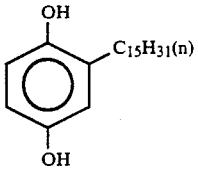
Ultraviolet absorbent (UV-41)
4:2:4 mixture (weight ratio) of:
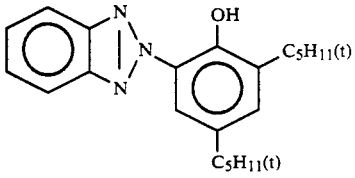
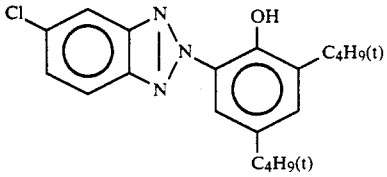
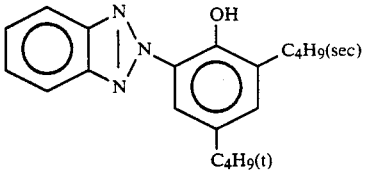
Solvent (Solv-41)
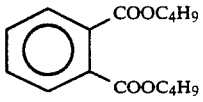
Solvent (Solv-42)
1:1 mixture (volumetric ratio) of:
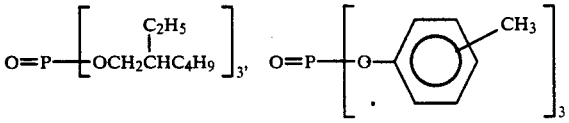
Solvent (Solv-43)
$O{=}P{+}O{-}C_9H_{19}(iso)]_3$
Solvent (Solv-44)
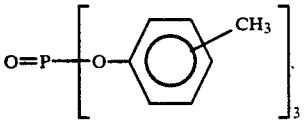
Solvent (Solv-45)

-continued $COOC_8H_{17}$
|
$(CH_2)_8$
|
$COOC_8H_{17}$

Solvent (Solv-46)

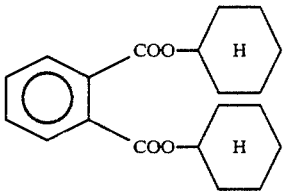

The specimen thus obtained was then used as Specimen I. Specimen II was prepared in the same manner as described above except that a silver chlorobromide emulsion having a silver bromide content of 6 mol % was incorporated in the 1st, 3rd and 5th layers.

Specimens I and II thus obtained were then imagewise exposed to light, and subjected to running test with various processing solutions in the steps described below. The composition of preservative in the color developer was modified as shown in Table 6.

TABLE 6

| Color developer | Preservative used |
|---|---|
| A | N,N-diethylhydroxylamine |
| B | N,N-dimethylhydroxylamine |
| C | (II-7) |
| D | (I-2) |
| E | (I-7) |
| F | (I-13) |

Note: The preservatives added to the developers C to F are represented by the reference number of the above described exemplified compounds of the present invention.

| Processing Step | Temperature | Time | Replenishment Rate* | Tank Volume |
|---|---|---|---|---|
| Color development | 38° C. | 45 sec. | 161 ml | 10 l |
| Blix | 30–36° C. | 45 sec. | 215 ml | 10 l |
| Stabilization 1 | 30–37° C. | 20 sec. | — | 5 l |
| Stabilization 2 | 30–37° C. | 20 sec. | — | 5 l |
| Stabilization 3 | 30–37° C. | 20 sec. | 250 ml | 5 l |
| Drying | 70–85° C. | 60 sec. | | |

*per $m^2$ of light-sensitive material
(The stabilization step was effected in a countercurrent process in which the processing solution flows in a direction opposite the processing sequence.)

The composition of the various processing solutions were as follows:

| | Running Solution | Replenisher |
|---|---|---|
| Color developer | | |
| Water | 800 ml | 800 ml |
| Ethylenediamine-N,N,N',N'-tetramethylenephosphonic acid | 4.0 g | 4.0 g |
| Triethanolamine | 8.0 g | 8.0 g |
| Sodium chloride | 3.2 g | — |
| Potassium carbonate | 25 g | 25 g |
| N-ethyl-N-(β-methanesulfonamidoethyl)-3-methyl-4-aminoaniline sulfate | 5.0 g | 7.0 g |
| Preservative as set forth in Table 6 | 0.05 mol | 0.075 mol |
| Fluoresecent brightening agent (4,4'-diaminostilbene series) | 2.0 g | 2.5 g |
| Potassium bromide | 0.02 g | — |
| Water to make | 1,000 ml | 1,000 ml |
| pH (25° C.) | 10.05 | 10.45 |
| Blix solution | | |
| Water | 400 ml | same as running solution |
| 70% Ammonium thiosulfate | 100 ml | same as running solution |
| Sodium sulfite | 17 g | same as running solution |
| Ferric (III) ammonium ethylenediaminetetraacetate | 55 g | same as running solution |
| Disodium ethylenediaminetetraacetate | 5 g | same as running solution |
| Glacial acetic acid | 9 g | same as running solution |
| Water to make | 1,000 ml | same as running solution |
| pH (25° C.) | 5.40 | same as running solution |
| Stabilizing solution | | |
| 1-Hydroxyethylidene-1,1-diphosphonic acid (60%) | 1.5 g | same as running solution |
| Nitrilo-N,N,N-trimethylenephosphonic acid | 1.0 g | same as running solution |
| 5-Chloro-2-methyl-4-isothiazoline-3-one | 0.02 g | same as running solution |
| 2-Methyl-4-isothiazoline-3-one | 0.01 g | same as running solution |
| 25% Aqueous ammonia | 1.0 ml | same as running solution |
| Water to make | 1,000 ml | 1,000 ml |
| pH (25° C.) | 6.0 | 6.0 |

In the above described continuous processing, the amount of the processing solution carried over per $m^2$ of light-sensitive material was 50 ml. The amount of the light-sensitive material processed per day was 10 $m^2$.

The overflow liquid from the color developing bath was collected to obtain a stock solution. When the replenisher was supplied in an amount of 20 liter, the stocked amount of the replenisher reached 13.5 liter.

The following chemicals were then added to 13.5 liter of the stock solution. Water was then added to the stock solution to make 20 liter. The stock solution thus regenerated was reused as the replenisher.

| | |
|---|---|
| Stock solution | 13.5 l |
| Ethylenediamine-N,N,N',N'-tetramethylenephosphonic acid | 26 g |
| Triethanolamine | 50 g |
| Potassium carbonate | 160 g |
| N-ethyl-N-[β-methanesulfonamideethyl]-3-methyl-4-aminoaniline sulfate | 78 g |
| Preservative as incorporated in developer | 0.825 mol |
| Fluorescent brightening agent | 23 g |
| Water to make | 20 l |
| pH adjusted with KOH to | 10.45 |

The above described regeneration was repeated 10 times for each of Color Developers A to F. At the beginning and the end of each running test, Specimen I which had been imagewise exposed to light with a step wedge were processed. The change in photographic properties, i.e., yellow, magenta and cyan minimum density and maximum density (Dmax) were measured.

Change in photographic properties

ΔDmin: density change on minimum density (unexposed portion)

$\Delta S_{0.5}$: change in log E at point where density is 0.5 (sensitivity change)

ΔSES: change in density at point where density is 0.5 higher than point with density of 0.5 in log E (gradation change)

The results are set forth in Table 7.

TABLE 7

| Specimen | Color developer | Remarks | ΔDmin | | | $\Delta S_{0.5}$ | | | ΔSES | | |
|---|---|---|---|---|---|---|---|---|---|---|---|
| | | | Y | M | C | Y | M | C | Y | M | C |
| I | A | Present invention | +0.02 | +0.01 | 0 | −0.04 | −0.05 | −0.06 | +0.08 | +0.10 | +0.13 |
| " | B | Present invention | +0.04 | +0.02 | +0.01 | −0.04 | −0.07 | −0.09 | +0.12 | +0.14 | +0.19 |
| " | C | Present invention | +0.01 | 0 | 0 | −0.01 | −0.01 | −0.01 | 0 | +0.02 | +0.03 |
| " | D | Present invention | 0 | 0 | 0 | −0.01 | −0.01 | 0 | 0 | +0.01 | +0.02 |
| " | E | Present invention | +0.01 | 0 | 0 | −0.02 | −0.02 | −0.02 | 0 | +0.01 | +0.02 |
| " | F | Present invention | 0 | 0 | 0 | −0.01 | −0.01 | −0.01 | 0 | +0.01 | +0.02 |
| II | A | Comparative | +0.04 | +0.03 | +0.02 | −0.08 | −0.09 | −0.11 | +0.13 | +0.18 | +0.21 |
| " | B | " | +0.04 | +0.03 | +0.02 | −0.08 | −0.10 | −0.11 | +0.12 | +0.19 | +0.23 |
| " | C | " | +0.05 | +0.02 | +0.01 | −0.07 | −0.09 | −0.10 | +0.16 | +0.14 | +0.20 |
| " | D | " | +0.04 | +0.02 | +0.01 | −0.07 | −0.09 | −0.10 | +0.17 | +0.14 | +0.20 |
| " | E | " | +0.04 | +0.02 | +0.01 | −0.07 | −0.09 | −0.10 | +0.17 | +0.14 | +0.20 |
| " | F | " | +0.04 | +0.02 | +0.01 | −0.07 | −0.09 | −0.10 | +0.17 | +0.14 | +0.20 |

The specimen I of the present invention exhibited a small change in Dmin, sensitivity and gradation after running processing (particularly with Color Developers C, D, E, and F), and provided excellent photographic properties.

EXAMPLE 5

The specimens as prepared in Example 4 were processed in the same manner as in Example 4 except that the amount of the light-sensitive material processed per day was changed to 40 $m^2$ (four times that in Example 4). Thus, the change in the photographic properties with the change in the amount of light-sensitive material being processed was determined. The results are set forth in Table 8.

TABLE 8

| Color developer | Remarks | ΔDmin | | | $\Delta S_{0.5}$ | | | ΔSES | | |
|---|---|---|---|---|---|---|---|---|---|---|
| | | Y | M | C | Y | M | C | Y | M | C |
| A | Present invention | +0.01 | 0 | 0 | −0.03 | −0.05 | −0.06 | −0.10 | −0.13 | −0.15 |
| B | Present invention | +0.03 | +0.01 | 0 | −0.04 | −0.06 | −0.08 | −0.12 | −0.15 | −0.20 |
| C | Present invention | 0 | 0 | 0 | +0.01 | 0 | 0 | 0 | 0 | 0 |
| D | Present invention | 0 | 0 | 0 | 0 | 0 | 0 | 0 | 0 | 0 |
| E | Present invention | 0 | 0 | 0 | +0.01 | +0.01 | 0 | 0 | 0 | 0 |
| F | Present invention | 0 | 0 | 0 | 0 | 0 | 0 | 0 | 0 | 0 |

It is clearly seen that the specimens using color developer C, D, E or F exhibited little change in photographic properties with an increase in the amount of light-sensitive material being processed per unit time while the specimens using color developer A or B exhibited a slight softer gradation (i.e., reduction in density). That is, the use of the color developer containing the compound represented by the general formula (I) or (II) in the present invention causes more stable photographic properties.

EXAMPLE 6

A multi-layer color photographic paper specimen II was prepared by coating various layers having the following compositions on a polyethylene double-laminated paper support. The coating solutions were prepared as follows:

Preparation of 1st layer coating solution 19.1 g of a yellow coupler (ExY-6), 4.4 g of a dye image stabilizer (Cpd-61) and 0.7 g of a dye image stabilizer (Cpd-67) were dissolved in 27.2 cc of ethyl acetate and 8.2 g of a solvent (Solv-61). The solution thus obtained was then emulsion-dispersed in 185 cc of a 10% aqueous solution of gelatin containing 8 cc of 10% sodium dodecylbenzenesulfonate. On the other hand, a blue-sensitive sensitizing dye of the following formula was added to a silver chlorobromide emulsion (3:7 mixture (molar ratio as calculated in terms of silver) of cubic grain with a mean grain size of 0.88 μm and grain size distribution fluctuation coefficient of 0.06 and cubic grain with a mean grain size of 0.70 μm and grain size distribution fluctuation coefficient of 0.10, each comprising 0.1 mol % of silver bromide localized on the surface thereof) in an amount of $2.0\times10^{-4}$ mol per mol of silver for the large grain size emulsion and $2.5\times10^{-5}$ mol per mol of silver for the small given size emulsion, respectively. The emulsion was then sulfur-sensitized. The emulsion dispersion previously prepared and the emulsion thus prepared were mixed and dissolved to prepare the 1st layer coating solution having the following composition.

The coating solutions for the 2nd layer to the 7th layer were prepared in the same manner as described above. As a gelatin hardener for each layer, the sodium salt of 1-oxy-3,5-dichloro-s-triazine was used.

As spectral sensitizing dyes for the various layers, the following compounds were used:

Blue-sensitive emulsion layer

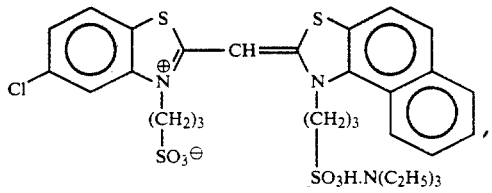

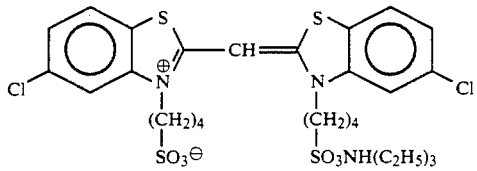

($3.0\times10^{-4}$ mol per mol of silver halide for the large grain size emulsion and $4.0\times10^{-4}$ mol per mol of silver halide for the small grain size emulsion)

Green-sensitive emulsion layer

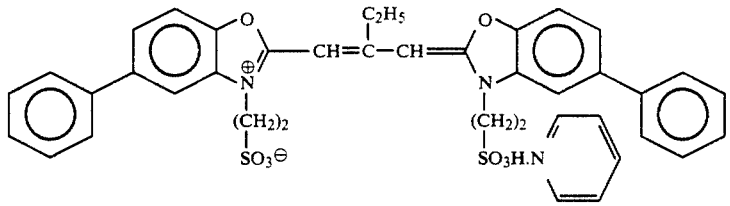

($5.0\times10^{-4}$ mol per mol of silver halide for the large grain size emulsion and $6.0\times10^{-4}$ mol per mol of silver halide for the small grain size emulsion)

and

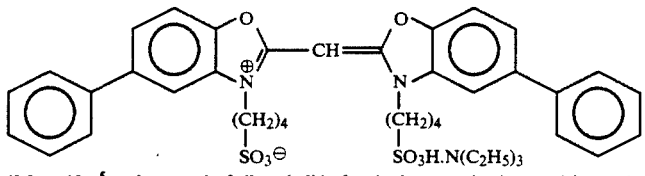

($8.0\times10^{-5}$ mol per mol of silver halide for the large grain size emulsion and $1.2\times10^{-5}$ mol per mol of silver halide for the small grain size emulsion)

Red-sensitive emulsion layer

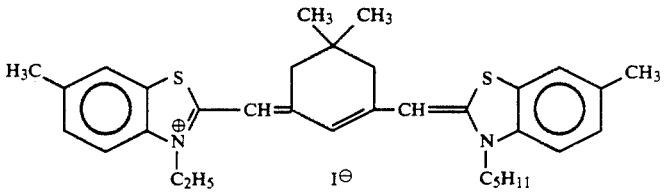

($0.7\times10^{-4}$ per mol of silver halide for the large grain size emulsion and -continued 1.2 × $10^{-4}$ mol per mol of silver halide for the small grain size emulsion)

The following compound was incorporated in the red-sensitive emulsion layer in an amount of $2.6\times10^{-3}$ mol per mol of silver halide.

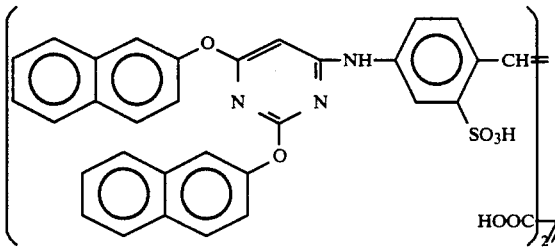

1-(5-Methylureidephenyl)-5-mercaptotetrazole was incorporated into the blue-sensitive emulsion layer, green-sensitive emulsion layer and red-sensitive emulsion layer in amounts of $8.5\times10^{-5}$ mol, $7.7\times10^{-4}$ mol and $2.5\times10^{-4}$ mol per mol of silver halide, respectively.

4-Hydroxy-6-methyl-1,3,3a,7-tetrazaindene was incorporated into the blue-sensitive emulsion layer and green-sensitive emulsion layer in amounts of $1\times10^{-4}$ mol and $2\times10^{-4}$ mol per mol of silver halide, respectively.

For the purpose of inhibiting irradiation, the following dyes were incorporated into the emulsion layers.

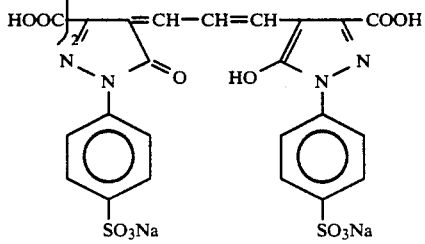

and

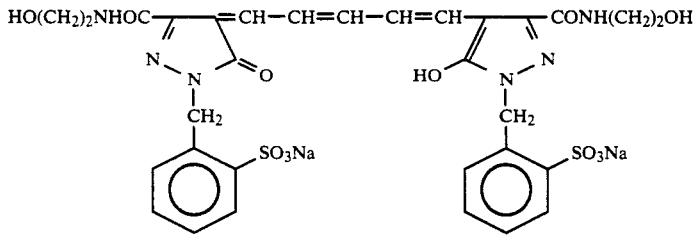

Layer structure

The composition of the various layers is set forth below in units g/m². The silver halide emulsion content is represented in terms of the amount of silver.

| | |
|---|---|
| Support | |
| Polyethylene-laminated paper [containing a white pigment ($TiO_2$) and a bluing dye (ultramarine) in the polyethylene layer on the side coated with the 1st layer] | |
| 1st Layer (blue-sensitive layer) | |
| Above described silver bromochloride emulsion | 0.25 |
| Gelatin | 1.86 |
| Yellow coupler (ExY-6) | 0.82 |
| Dye image stabilizer (Cpd-61) | 0.19 |
| Solvent (Solv-61) | 0.35 |
| Dye image stablizer (Cpd-67) | 0.06 |
| 2nd Layer (color stain inhibiting layer) | |
| Gelatin | 0.99 |
| Color stain inhibitor (Cpd-65) | 0.08 |
| Solvent (Solv-61) | 0.16 |
| Solvent (Solv-64) | 0.08 |
| 3rd Layer (green-sensitive layer) | |
| Silver chlorobromide emulsion (1:3 mixture (Ag molar ratio) of cubic grain with a mean grain size of 0.55 μm and a fluctuation coefficient of 0.10 and cubic grain with a mean grain size of 0.39 μm and a fluctuation coefficent of 0.08, each comprising 0.5 mol % of silver bromide localized on surface thereof) | 0.12 |
| Gelatin | 1.24 |

-continued

| | |
|---|---|
| Magenta coupler (ExM-6) | 0.20 |
| Dye image stabilizer (Cpd-62) | 0.03 |
| Dye image stabilizer (Cpd-63) | 0.15 |
| Dye image stabilizer (Cpd-64) | 0.02 |
| Dye image stabilizer (Cpd-69) | 0.02 |
| Solvent (Solv-62) | 0.40 |
| 4th Layer (ultraviolet-absorbing layer) | |
| Gelatin | 1.58 |
| Ultraviolet absorbent (UV-61) | 0.47 |
| Color stain inhibitor (Cpd-65) | 0.05 |
| Solvent (Solv-65) | 0.24 |
| 5th Layer (red-sensitive layer) | |
| Silver chlorobromide emulsion (1:4 mixture (Ag molar ratio) of cubic grain with a mean grain size of 0.58 μm and a fluctuation coefficient of 0.09 and cubic grain with a mean grain size of 0.45 μm and a fluctuation coefficient of 0.11, each comprising 0.3 mol % of silver bromide localized on surface thereof) | 0.18 |
| Gelatin | 1.34 |
| Cyan coupler (ExC-6) | 0.32 |
| Dye image stabilizer (Cpd-66) | 0.17 |
| Dye image stabilizer (Cpd-67) | 0.40 |
| Dye image stabilizer (Cpd-68) | 0.04 |
| Solvent (Solv-66) | 0.15 |
| 6th Layer (ultraviolet-absorbing layer) | |
| Gelatin | 0.53 |
| Ultraviolet absorbent (UV-61) | 0.16 |
| Color stain inhibitor (Cpd-65) | 0.02 |
| Solvent (Solv-65) | 0.08 |
| 7th Layer (protective layer) | |
| Gelatin | 1.33 |
| Acryl-modified copolymer of polyvinyl alcohol (modification degree: 17%) | 0.17 |
| Liquid paraffin | 0.03 |

Yellow coupler (ExY-6)

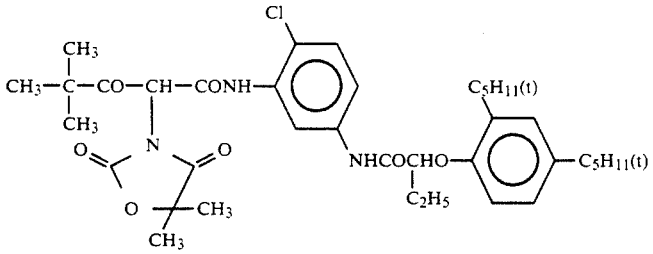

Magenta coupler (ExM-6)

1:1 mixture (molar ratio) of:

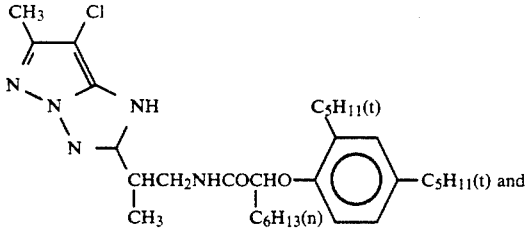

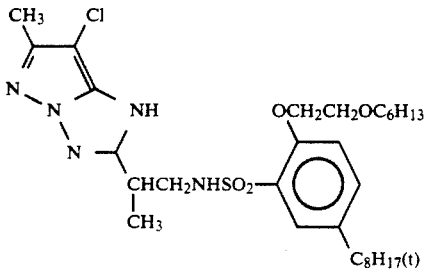

Cyan coupler (Exc-6)

-continued
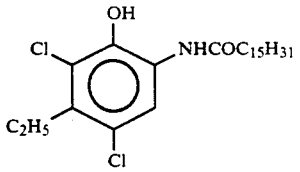
Dye image stabilizer (Cpd-61)
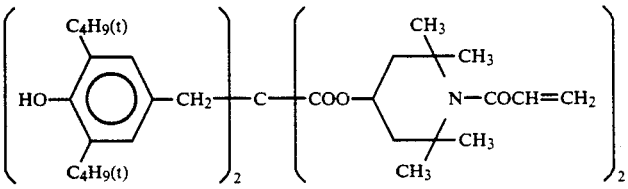
Dye image stabilizer (Cpd-62)
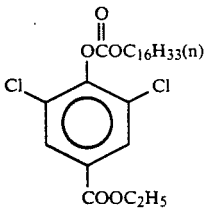
Dye image stabilizer (Cpd-63)
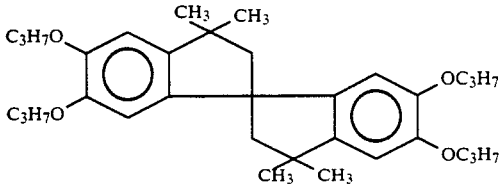
Dye image stabilizer (Cpd-64)
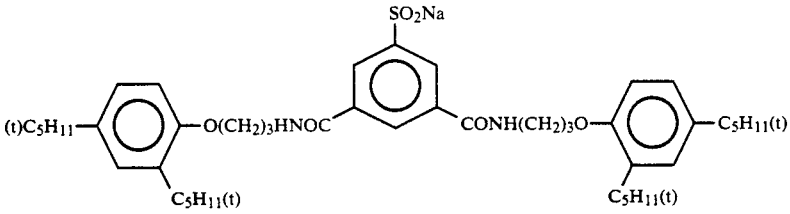
Dye image stabilizer (Cpd-65)
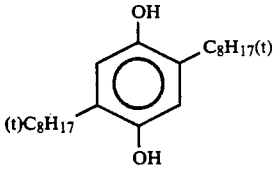
Dye image stabilizer (Cpd-66)
2:4:4 mixture (weight ratio) of:
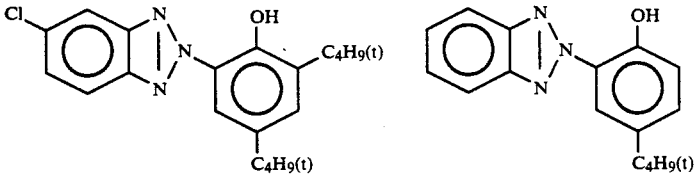

-continued
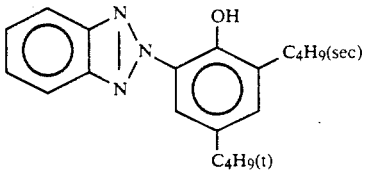
Dye image stabilizer (Cpd-67)
$$\left(CH_2-\underset{\underset{CONHC_4H_9(t)}{|}}{CH}\right)_n$$
Average molecular weight: 60,000
Dye image stabilizer (Cpd-68)
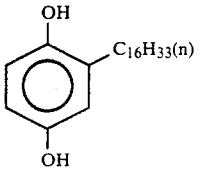
Dye image stabilizer (Cpd-69)
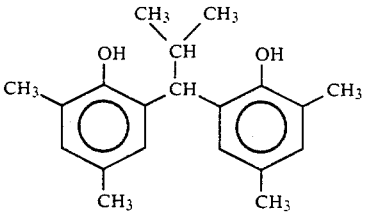
Ultraviolet absorbent (UV-61)
4:2:4 mixture (weight ratio) of:
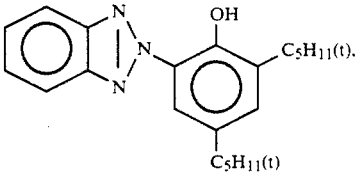
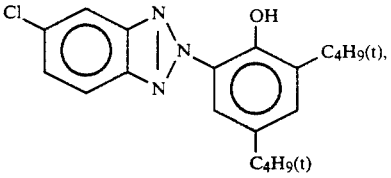
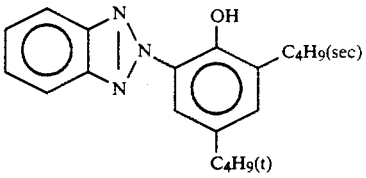
Solvent (Solv-61)
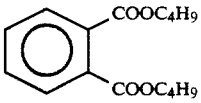
Solvent (Solv-62)
2:1 mixture (volumetric ratio) of:
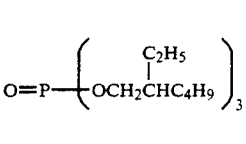
and
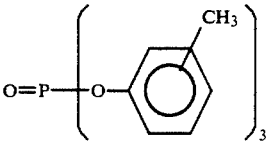
Solvent (Solv-64)

-continued

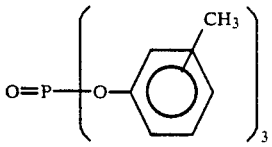

Solvent (Solv-65)

$COOC_8H_{17}$
|
$(CH_2)_8$
|
$COOC_8H_{17}$

Solvent (Solv-66)

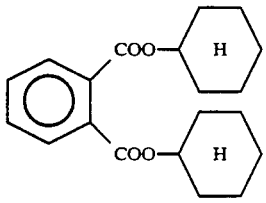

Specimen II thus obtained was then imagewise exposed to light, and subjected to continuous processing in the following steps with the composition of the preservative in the color developer being changed as set forth in Table 9.

TABLE 9

| Color developer | Preservative used |
|---|---|
| G | N,N-diethylhydroxylamine |
| H | (II-7) |
| I | (I-2) |
| J | (I-7) |

| Processing Step | Temperature | Time | Replenishment Rate* | Tank Volume |
|---|---|---|---|---|
| Color development | 38° C. | 45 sec. | 150 ml | 15 l |
| Blix | 30–36° C. | 45 sec. | 60 ml | 15 l |
| Stabilization 1 | " | " | — | 7 l |
| Stabilization 2 | " | " | — | 7 l |
| Stabilization 3 | " | " | — | 7 l |
| Stabilization 4 | " | " | — | 7 l |
| Stabilization 5 | " | " | 250 ml | 10 l |

*per $m^2$ of light-sensitive material
(The stabilization step was effected in a countercurrent process in which the processing solution flows in a direction opposite the processing sequence.)

(The stabilization step was effected in a countercurrent process in which the processing solution flows in a direction opposite the processing sequence.)

| | Running Solution | Replenisher |
|---|---|---|
| Color developer | | |
| Water | 800 ml | 800 ml |
| Ethylenediamine-N,N,N',N'-tetramethylenephosphonic acid | 4.0 g | 4.0 g |
| Triethanolamine | 8.0 g | 8.0 g |
| Sodium chloride | 2.8 g | — |
| Potassium bromide | 0.015 g | — |
| Potassium carbonate | 25 g | 25 g |
| N-ethyl-N-(β-methanesulfonamidoethyl)-3-methyl-4-aminoaniline sulfate | 5.0 g | 7.5 g |
| Preservative as set forth in Table 9 | 0.05 mol | 0.075 mol |
| Fluoresecent brightening agent (UV-500, available from Sumitomo Chemical Co., Ltd.) | 2.0 g | 2.5 g |

-continued

| | Running Solution | Replenisher |
|---|---|---|
| Water to make | 1,000 ml | 1,000 ml |
| pH (25° C.) | 10.05 | 10.50 |
| Blix solution | | |
| 70% Ammonium thiosulfate | 110 ml | 220 ml |
| Ammonium sulfite | 19 g | 38 g |
| Ammonium bromide | 25 g | 50 g |
| Ferric (III) ammonium ethylenediaminetetraacetate | 55 g | 110 g |
| Ethylenediaminetetraacetic acid | 1.5 g | 3 g |
| 67% Nitric acid | 24.5 g | 49 g |
| Water to make | 1,000 ml | 1,000 ml |
| pH | 5.20 | 4.80 |

Washing water

Ion-exchanged water having calcium and magnesium concentrations of 5 ppm each

In the above described continuous processing, the amount of the processing solution carried over per $m^2$ of light-sensitive material was 55 ml. The amount of the light-sensitive material processed per day was 20 $m^2$.

The overflow liquid from the color developing bath was collected to obtain a stock solution. When the replenisher was supplied in an amount of 30 liter, the stocked amount of the replenisher reached 18.5 liter.

The following chemicals were then added to 18.5 liter of the stock solution. Water was then added to the stock solution to make 30 liter. The stock solution thus regenerated was reused as the replenisher.

| | |
|---|---|
| Stock solution | 18.5 l |
| Ethylenediamine-N,N,N',N'-tetramethylenephosphonic acid | 46 g |
| Triethanolamine | 90 g |
| Potassium carbonate | 280 g |
| N-ethyl-N-[β-methanesulfonamideethyl]-3-methyl-4-aminoaniline sulfate | 100 g |
| Preservative as incorporated in developer | 1.2 g |
| Fluorescent brightening agent | 35 g |
| Water to make | 30 l |

-continued

| | |
|---|---|
| pH | 10.50 |

The running test was effected while the above described regeneration was repeated in the same manner as in Example 4. Thus, the change in photographic properties was determined.

The results are set forth in Table 10.

TABLE 10

| Color developer | Remarks | ΔDmin | | | $\Delta S_{0.5}$ | | | ΔSES | | |
|---|---|---|---|---|---|---|---|---|---|---|
| | | Y | M | C | Y | M | C | Y | M | C |
| H | Present invention | +0.01 | 0 | 0 | −0.01 | −0.01 | −0.01 | +0.01 | −0.02 | +0.01 |
| I | Present invention | 0 | 0 | 0 | −0.01 | −0.01 | −0.01 | +0.02 | −0.01 | +0.01 |
| J | Present invention | 0 | 0 | 0 | −0.01 | −0.01 | −0.01 | +0.01 | −0.01 | +0.01 |

The specimens of the present invention exhibited a small change in Dmin, sensitivity and gradation after running processing (particularly with Color Developers H, I, and J), providing excellent photographic properties.

In the method of the present invention, regeneration of a color developer is easily accomplished and is advantageous with respect to environmental protection and economy without the necessity of large scale facilities. The method of the present invention also provides excellent photographic properties while generating substantially no waste water and without crystallization of chemicals in the replenisher even after repeated regeneration of the replenisher. In particular, stable and excellent photographic properties are obtained even when the amount of light-sensitive material being processed per unit time is varied.

While the invention has been described in detail and with reference to specific embodiments thereof, it will be apparent to one skilled in the art that various changes and modifications can be made therein without departing from the spirit and scope thereof.

What is claimed is:

1. A method for continuously processing an imagewise exposed silver halide color photographic material comprising a support having thereon at least one silver halide emulsion layer containing 95 mol % or more of silver chloride, comprising (a) developing the silver halide color photographic material in a developing tank containing a color developer, (b) supplying a replenisher to the color developer to result in an overflow of used color developer from the developing tank, (c) collecting the overflow liquid in a stock tank, (d) adding a regenerant to the stocked overflow liquid to obtain a color developer replenisher, and (e) replenishing the color developer of step (b) with said replenisher from step (d), wherein components accumulated in the color developer during the continuous processing are not removed from the replenisher, the replenishment rate to the color developer is in the range of 1.2 to 20 times the amount of color developer carried over with the developed photographic material to a succeeding bath, and the regenerating rate defined as the amount of overflow used for regeneration divided by the total amount of overflow multiplied by 100% is at least 80%.

2. A method as in claim 1, wherein said color developer contains at least one compound selected from the compounds represented by the general formulae (I) and (II):

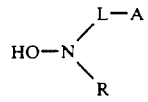

(I)

wherein L represents a substituted or unsubstituted alkylene group; A represents a carboxy group, a sulfo group, a phosphono group, a phosphinic acid residue, a hydroxy group, an amino group which may be alkyl-substituted, an ammonio group which may be alkyl-substituted, a carbamoyl group which may be alkyl-substituted, a sulfamoyl group which may be alkyl-substituted or an alkylsulfonyl group which may be alkyl-substituted; and R represents a hydrogen atom or a substituted or unsubstituted alkyl group:

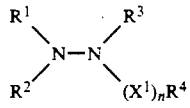

(II)

wherein $R^1$, $R^2$ and $R^3$ each independently represent a hydrogen atom, an alkyl group, an aryl group or a heterocyclic group; $R^4$ represents a hydrogen atom, a hydroxyl group, a hydrazino group, an alkyl group, an aryl group, a heterocyclic group, an alkoxy group, an aryloxy group, a carbamoyl group or an amino group; $X^1$ represents a divalent group; and n represents an integer of 0 or 1, with the proviso that when n is 0, $R^4$ represents an alkyl group, an aryl group or a heterocyclic group, or $R^3$ and $R^4$ combine to form a heterocyclic group.

3. A method as in claim 1, wherein the total coated amount of silver in the silver halide color photographic material is in the range of from 0.3 to 0.8 g per $m^2$ of the photographic material.

4. A method as in claim 1, wherein the carryover of the color developer to a succeeding bath is in the range of from 30 to 80 ml per $m^2$ of the processed photographic material.

5. A method as in claim 2, wherein the addition amount of the at least one compound selected from the compounds represented by formulae (I) and (II) is in the range of from 0.01 to 50 g per liter of the color developer.

6. A method as in claim 1, wherein the regenerant comprises the same type of color developing agent contained in the color developer.

7. A method as in claim 1, wherein the regenerant contains active components of the color developer which are consumed in the continuous processing.

8. A method as in claim 1, wherein the regenerant contains active components of the color developer in an amount which compensates for the amount of the active components consumed in the continuous processing.

9. A method as in claim 1, wherein the at least one silver halide emulsion layer contains 98 mol % or more silver chloride.

10. A method as in claim 1, wherein the total coated amount of silver in the silver halide color photographic material is in the range of from 0.4 to 0.7 g per $m^2$ of the photographic material.

11. A method as in claim 1, wherein the regenerating rate is 90–100%.

12. A method as in claim 1, wherein halogen ions accumulate in the color developer during the continuous processing.

* * * * *